US011267158B1

(12) United States Patent
Kilgore

(10) Patent No.: US 11,267,158 B1
(45) Date of Patent: Mar. 8, 2022

(54) CUTTING APPARATUS AND METHOD FOR FORMING CYLINDRICAL, CONICAL, AND/OR ANNULAR STOCK MATERIALS

(71) Applicant: Robert Loring Kilgore, Taberg, NY (US)

(72) Inventor: Robert Loring Kilgore, Taberg, NY (US)

( * ) Notice: Subject to any disclaimer, the term of this patent is extended or adjusted under 35 U.S.C. 154(b) by 0 days.

(21) Appl. No.: 16/574,079

(22) Filed: Sep. 17, 2019

Related U.S. Application Data

(62) Division of application No. 14/534,145, filed on Nov. 5, 2014, now abandoned.

(60) Provisional application No. 61/900,454, filed on Nov. 6, 2013.

(51) Int. Cl.
*B27B 13/04* (2006.01)
*B27B 29/02* (2006.01)
*B27C 7/00* (2006.01)

(52) U.S. Cl.
CPC ..... *B27B 13/04* (2013.01); *B27B 29/02* (2013.01); *B27C 7/00* (2013.01)

(58) Field of Classification Search
CPC ..... B27B 13/04; B27B 15/02; B27B 15/04; B27B 17/0075; B27B 29/02; B27B 31/04; B27B 31/08; B23D 55/04; B27C 7/00; Y10T 83/7201; B28D 1/02; B28D 1/047;
(Continued)

(56) References Cited

U.S. PATENT DOCUMENTS

| | | | |
|---|---|---|---|
| 9,120 | A | 7/1852 | Reading |
| 405,148 | A | 6/1889 | Dallas |
| 509,534 | A | 11/1893 | Hayne |

(Continued)

FOREIGN PATENT DOCUMENTS

| | | | | |
|---|---|---|---|---|
| CA | 200464 | A | | 6/1920 |
| GB | 2253587 | B | | 2/1994 |
| JP | 2005246573 | A | * | 9/2005 |

OTHER PUBLICATIONS

First office action on the merits (Non-Final Rejection) in U.S. Appl. No. 14/534,145, dated Apr. 7, 2017.

(Continued)

*Primary Examiner* — Ghassem Alie
*Assistant Examiner* — Samuel A Davies
(74) *Attorney, Agent, or Firm* — The Law Office of Patrick F. O'Reilly III, LLC

(57) ABSTRACT

A cutting apparatus is disclosed herein. The cutting apparatus includes a workpiece support assembly, the workpiece support assembly configured to hold a workpiece in position by means of one or more rotational attachment points, the workpiece support assembly allowing generally single degree of freedom rotation while the workpiece is being cut, and the workpiece support assembly generally fixing the workpiece in the other directions of movement during the cutting thereof; and a cutting assembly having a cutting blade, the cutting blade configured to engage the workpiece, and circumferentially cut a portion of material from the workpiece. In some embodiments, the cutting blade may comprise a rotary cutting blade or a linearly displaceable cutting blade configured to tangentially engage the workpiece. A method for forming cylindrical, conical, and/or annular stock materials, which utilizes the cutting apparatus, is also disclosed herein.

15 Claims, 35 Drawing Sheets

(58) Field of Classification Search
CPC .. B28D 1/08; B28D 1/22; B28D 7/043; B27L 5/00
See application file for complete search history.

(56) References Cited

U.S. PATENT DOCUMENTS

| | | | | | |
|---|---|---|---|---|---|
| 596,738 | A * | 1/1898 | Castle | B23D 59/00 | 83/410.9 |
| 767,466 | A * | 8/1904 | Wolfinger | B27L 5/004 | 144/211 |
| 1,420,218 | A * | 6/1922 | Richards | B23Q 1/4804 | 269/57 |
| 1,765,161 | A * | 6/1930 | Kaempf | B23D 51/046 | 83/410.9 |
| 2,686,095 | A * | 8/1954 | Carlson | B28D 7/043 | 108/4 |
| 2,827,084 | A * | 3/1958 | Massongill | B23D 55/026 | 83/432 |
| 3,037,538 | A | 6/1962 | Graham | | |
| 3,153,433 | A | 10/1964 | Ferrara | | |
| 3,299,877 | A | 1/1967 | Grage | | |
| 3,566,722 | A | 3/1971 | Audet | | |
| 3,630,245 | A | 12/1971 | Monahan | | |
| 3,648,743 | A * | 3/1972 | Fino | B27B 31/06 | 83/415 |
| 3,739,822 | A * | 6/1973 | Lööf | B27C 7/00 | 142/1 |
| 3,797,542 | A | 3/1974 | Wood | | |
| 3,995,521 | A * | 12/1976 | Raphael | B23D 33/04 | 83/410.9 |
| 4,111,085 | A | 9/1978 | Johnson | | |
| 4,144,782 | A | 3/1979 | Lindstrom | | |
| 4,245,535 | A | 1/1981 | Lockwood et al. | | |
| 4,303,111 | A | 12/1981 | Neville | | |
| 4,519,429 | A | 5/1985 | Dreese | | |
| 4,549,586 | A | 10/1985 | Klocker | | |
| 4,562,873 | A | 1/1986 | Krocher et al. | | |
| 4,739,872 | A * | 4/1988 | Roberts | B23Q 7/048 | 198/346.2 |
| 4,796,681 | A | 1/1989 | Hayes | | |
| 5,035,166 | A * | 7/1991 | Carlson | B27B 15/02 | 83/801 |
| 5,109,899 | A | 5/1992 | Henderickson | | |
| 5,191,824 | A | 3/1993 | Rathbun, Jr. | | |
| 5,303,689 | A * | 4/1994 | Mayer | B23D 57/0061 | 125/21 |
| 5,503,202 | A | 4/1996 | Butler | | |
| 5,605,085 | A | 2/1997 | Bohrer | | |
| 5,630,454 | A | 5/1997 | Koike | | |
| 5,667,000 | A | 9/1997 | Bean | | |
| 5,688,098 | A * | 11/1997 | Theno | B65G 1/0442 | 414/277 |
| 5,749,273 | A | 5/1998 | Rimlinger, Jr. | | |
| 6,223,413 | B1 | 5/2001 | Crocker et al. | | |
| 6,293,320 | B1 | 9/2001 | McGregor, II | | |
| 6,629,549 | B2 | 10/2003 | Rioux | | |
| 6,776,202 | B1 | 8/2004 | Dziesinski et al. | | |
| 7,069,632 | B2 | 7/2006 | Ferdolage | | |
| 7,377,022 | B2 | 5/2008 | Hall | | |
| 8,220,134 | B2 | 7/2012 | Burns et al. | | |
| 8,353,095 | B2 | 1/2013 | Hall | | |
| 8,387,493 | B2 | 3/2013 | Monroe | | |
| 8,424,576 | B1 | 4/2013 | Coyner | | |
| 2002/0038587 | A1 | 4/2002 | Rioux | | |
| 2002/0153059 | A1 | 10/2002 | Cassady, II | | |
| 2003/0089211 | A1 | 5/2003 | Lin | | |
| 2007/0006706 | A1 | 1/2007 | Watanabe et al. | | |
| 2007/0117068 | A1* | 5/2007 | Nelms | G09B 9/02 | 434/29 |
| 2007/0137456 | A1 | 6/2007 | Liao | | |
| 2007/0267006 | A1* | 11/2007 | Ogyu | B28D 1/08 | 125/21 |
| 2011/0162499 | A1* | 7/2011 | Cooper | B26D 5/32 | 83/76.8 |
| 2015/0053196 | A1* | 2/2015 | Bennett | B23D 61/185 | 125/21 |
| 2016/0207223 | A1* | 7/2016 | Schlough | B28D 1/043 | |

OTHER PUBLICATIONS

Second office action on the merits (Final Rejection) in U.S. Appl. No. 14/534,145, dated Nov. 29, 2017.
Third office action on the merits (Non-Final Rejection) in U.S. Appl. No. 14/534,145, dated Aug. 8, 2018.
Fourth office action on the merits (Final Rejection) in U.S. Appl. No. 14/534,145, dated Mar. 18, 2019.
First office action on the merits (Non-Final Rejection) in U.S. Appl. No. 15/684,111, dated Jun. 3, 2020.

* cited by examiner

CUTTING APPARATUS AND METHOD FOR FORMING CYLINDRICAL, CONICAL, AND/OR ANNULAR STOCK MATERIALS

CROSS-REFERENCE TO RELATED APPLICATIONS

This is a divisional of U.S. patent application Ser. No. 14/534,145, entitled "Cutting Apparatus and Method for Forming Cylindrical, Conical, and/or Annular Stock Materials", filed on Nov. 5, 2014; which claims priority to U.S. Provisional Patent Application No. 61/900,454, entitled "Cutting Apparatus and Method for Forming Cylindrical, Conical, and/or Annular Stock Materials", filed on Nov. 6, 2013, the disclosure of each of which is hereby incorporated by reference as if set forth in their entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a cutting apparatus. More particularly, the invention relates to a cutting apparatus that is configured to form cylindrical, conical, and/or annular stock materials.

2. Background and Description of Related Art

There are many known applications for stock materials that are round, radial, cylindrical and stave-like. For example, the wood working industry is in need of creating cut products that have the aforementioned geometries. However, the current processes for creating such a product use molding knives, conventional lathe cutting techniques, or inefficient boring methods. When used, for example, to create a solid wood product, these conventional techniques generate a vast amount of waste and scrap materials. In many of the conventional processes, a round tree is initially cut into square or rectangular boards, which in turn, are formed into round boards. As such, the need for creating a square or rectangular intermediate product, prior to creating the final circular product, results in a substantial amount of unnecessary waste shavings and sawdust being produced. These conventional cutting techniques also result in the inefficient use of our natural resources because an increased quantity of raw materials must be consumed in order to compensate for their shortcomings.

Therefore, what is needed is a cutting apparatus that is capable of more efficiently producing cylindrical, conical, and/or annular stock materials. Moreover, a cutting apparatus is needed that is capable of substantially reducing the amount of waste materials that are generated when forming cylindrical, conical, and/or annular stock materials. Furthermore, there is a need for a method for forming cylindrical, conical, and/or annular stock materials, which utilizes an efficient cutting apparatus that is capable of reducing the amount of raw materials that are consumed during production of a particular quantity of stock materials, as compared to conventional cutting methods.

BRIEF SUMMARY OF EMBODIMENTS OF THE INVENTION

Accordingly, the present invention is directed to a cutting apparatus and method for forming cylindrical, conical, and/or annular stock materials that substantially obviate one or more problems resulting from the limitations and deficiencies of the related art.

In accordance with one or more embodiments of the present invention, there is provided a cutting apparatus, which includes: a workpiece support assembly, the workpiece support assembly configured to hold a workpiece in position by means of one or more rotational attachment points, the workpiece support assembly allowing generally single degree of freedom rotation while the workpiece is being cut, and the workpiece support assembly generally fixing the workpiece in the other directions of movement during the cutting thereof; and a cutting assembly having a linearly displaceable cutting blade, the linearly displaceable cutting blade configured to tangentially engage the workpiece, and circumferentially cut a portion of material from the workpiece.

In a further embodiment of the present invention, the workpiece rotates about a rotational axis while being cut, the rotational axis of the workpiece being disposed generally parallel to a longitudinal extending direction of the linearly displaceable cutting blade, the rotational axis of the workpiece being disposed in a generally horizontal direction or a generally vertical direction.

In yet a further embodiment, the workpiece rotates about a rotational axis while being cut, the rotational axis of the workpiece being disposed at an acute angle relative to a longitudinal extending direction of the linearly displaceable cutting blade.

In still a further embodiment, the workpiece support assembly comprises a headstock assembly, and wherein the one or more rotational attachment points includes a rotational attachment point disposed on the headstock assembly.

In yet a further embodiment, the workpiece support assembly further comprises a tailstock assembly, and wherein the one or more rotational attachment points further includes a rotational attachment point disposed on the tailstock assembly.

In still a further embodiment, a lower section of the tailstock assembly is rotatably coupled to a base frame member of the workpiece support assembly.

In yet a further embodiment, the cutting apparatus further comprises a swing arm assembly configured to support the portion of material circumferentially cut from the workpiece after the portion of material has been removed from the workpiece.

In still a further embodiment, the swing arm assembly is configured to detachably engage with the tailstock assembly so as to facilitate the transfer of the cut portion of material from the workpiece support assembly to the swing arm assembly.

In yet a further embodiment, the swing arm assembly is rotatably disposed relative to the workpiece support assembly.

In still a further embodiment, the swing arm assembly comprises inner and outer upper arm members, the inner upper arm member being telescopically received within the outer upper arm member so as to allow the inner upper arm member to be slidably adjusted relative to the outer upper arm member.

In yet a further embodiment, the swing arm assembly further comprises a base member, and wherein a height of the inner and outer upper arm members relative to the base member is selectively adjustable by a user of the cutting apparatus.

In still a further embodiment, the workpiece support assembly further comprises a lower base frame section and an upper base frame section, the upper base frame section being pivotally coupled to the lower base frame section so as to enable the linearly displaceable cutting blade to cut the workpiece at an angle relative to a rotational axis of the workpiece.

In yet a further embodiment, the upper base frame section is pivotally coupled to the lower base frame section by means of one or more hinge members, each of the one or more hinge members being in the form of barrel hinges with removable pin members.

In still a further embodiment, the workpiece support assembly additionally comprises a scissor jack subassembly, the scissor jack subassembly configured to elevate a side of the upper base frame section above a side of the lower base frame section, thereby forming a gap between the side of the upper base frame section and the side of the lower base frame section.

In yet a further embodiment, the cutting assembly comprises one of a band saw and a chain saw, the linearly displaceable cutting blade forming a part of one of the band saw and the chain saw.

In still a further embodiment, the cutting assembly further comprises a support frame with opposed base frame members that are respectively attached to opposed upright support post members, each of the opposed base frame members comprising one or more wheel assemblies or each of the opposed base frame members engaging respective rail members for enabling the cutting assembly to be displaced relative to the workpiece support assembly In yet a further embodiment, the cutting assembly further comprises a cutting device, the linearly displaceable cutting blade forming a part of the cutting device, the cutting device being adjustably supported on the opposed upright support post members.

In still a further embodiment, the workpiece support assembly is in the form of a tabletop device, the tabletop device supporting the workpiece thereon.

In yet a further embodiment, the cutting apparatus is configured to be attached to one of: (i) an excavator, (ii) a skid-steer loader, (iii) a backhoe, and (iv) a fork lift.

In still a further embodiment, the workpiece support assembly comprises a workpiece rotational means that is operated by a computer numerical control (CNC) system.

In yet a further embodiment, the cutting assembly comprises a cutting device that is operated by a computer numerical control (CNC) system.

In still a further embodiment, the workpiece support assembly comprises a headstock assembly, the one or more rotational attachment points including a rotational attachment point disposed on the headstock assembly, and the headstock assembly comprising an expandable plunger device for engaging the workpiece.

In still a further embodiment, the workpiece support assembly comprises a single upright post member coupled to a workpiece retention yoke, the workpiece retention yoke configured to support the workpiece in a cantilevered manner above a base portion of the workpiece support assembly.

In yet a further embodiment, the workpiece retention yoke is rotatably adjustable relative to the single upright post member so as to enable the linearly displaceable cutting blade to cut the workpiece at an angle relative to a rotational axis of the workpiece.

In still a further embodiment, the workpiece support assembly comprises a rotating cylinder for supporting a plurality of workpieces therefrom.

In accordance with one or more other embodiments of the present invention, there is provided a cutting apparatus, which includes: a workpiece support assembly, the workpiece support assembly configured to hold a workpiece in position by means of one or more rotational attachment points, the workpiece support assembly allowing generally single degree of freedom rotation while the workpiece is being cut, and the workpiece support assembly generally fixing the workpiece in the other directions of movement during the cutting thereof; and a cutting assembly having a rotary cutting blade, the rotary cutting blade configured to engage the workpiece, and circumferentially cut a portion of material from the workpiece.

In a further embodiment of the present invention, the rotary cutting blade is configured to be inserted into a drilled or bored aperture of the workpiece prior to the portion of material being circumferentially cut from the workpiece.

In accordance with yet one or more other embodiments of the present invention, there is provided a method for forming cylindrical, conical, and/or annular stock materials, the method comprising the steps of: (i) providing a cutting apparatus, which includes a workpiece support assembly, the workpiece support assembly configured to hold a workpiece in position by means of one or more rotational attachment points, the workpiece support assembly allowing generally single degree of freedom rotation while the workpiece is being cut, and the workpiece support assembly generally fixing the workpiece in the other directions of movement during the cutting thereof; and a cutting assembly having a cutting blade, the cutting blade configured to engage the workpiece, and circumferentially cut a portion of material from the workpiece; (ii) holding, by using the workpiece support assembly, the workpiece in a generally stationary position relative to the cutting blade; (iii) displacing the cutting blade towards the workpiece until the cutting blade engages the workpiece at a predetermined location; and (iv) rotating the workpiece, by using the workpiece support assembly, so that a portion of material is circumferentially cut from the workpiece.

In a further embodiment of the present invention, the cutting blade comprises a linearly displaceable cutting blade; and the step of displacing the cutting blade towards the workpiece further comprises displacing the linearly displaceable cutting blade tangentially into the workpiece until the linearly displaceable cutting blade reaches the predetermined location in the workpiece.

In yet a further embodiment, the cutting blade comprises a rotary cutting blade; and the method further comprises the step of boring a hole into the workpiece at the predetermined location; the step of displacing the cutting blade towards the workpiece further comprises inserting the rotary cutting blade into the bored hole of the workpiece at the predetermined location; and the step of rotating the workpiece comprises making a circumferential cut into the workpiece using the rotary cutting blade.

In still a further embodiment, the step of rotating the workpiece comprises either manually rotating the workpiece using a hand crank or automatically rotating the workpiece using an actuator, the actuator comprising an electric motor.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
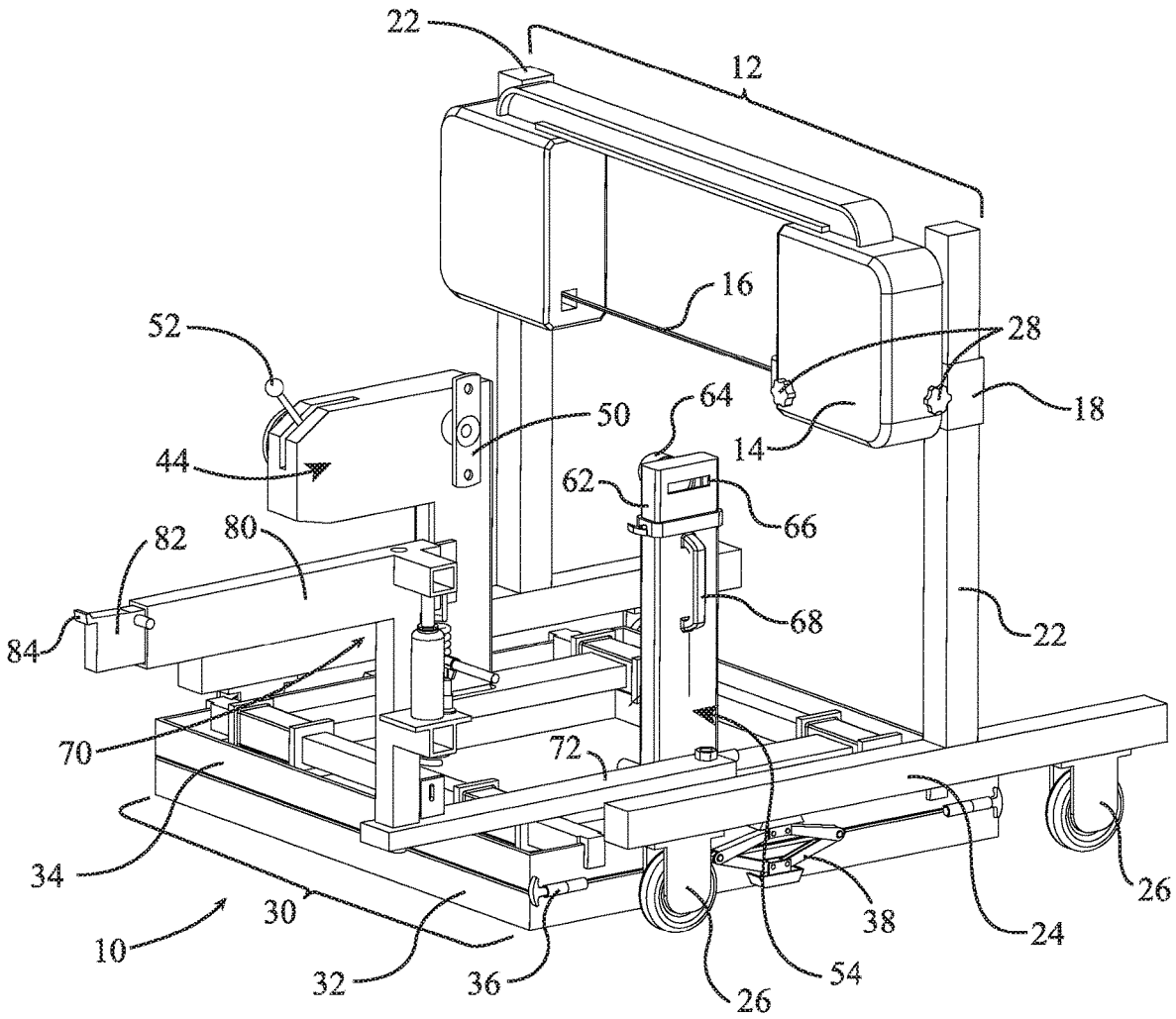
FIG. 1 is a perspective view of a cutting apparatus, according to an embodiment of the invention.
Figure 2:
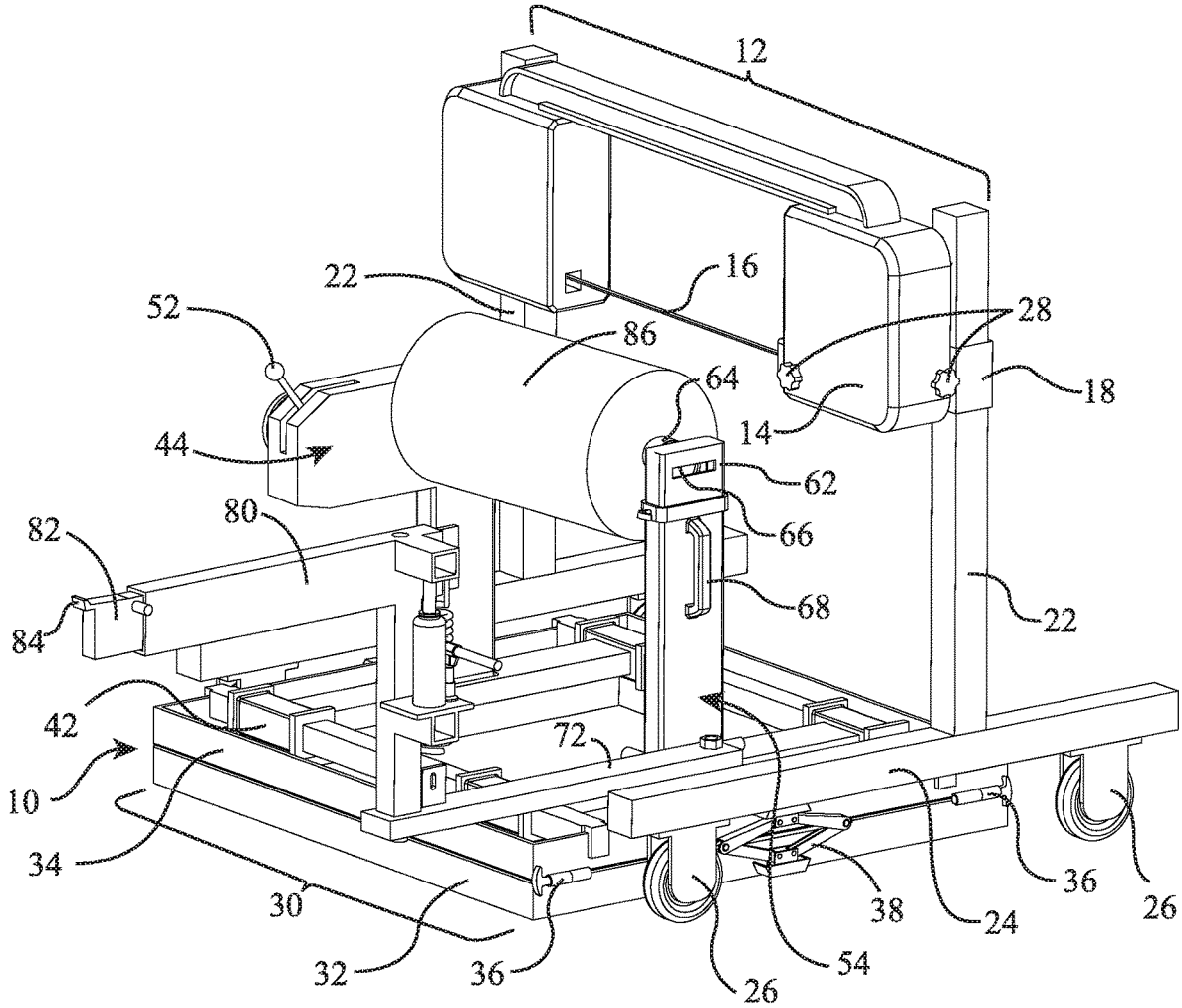
FIG. 2 is another perspective view of the cutting apparatus of FIG. 1, wherein a cylindrical workpiece is shown being supported by the workpiece support means of the cutting apparatus.

A first embodiment of the cutting apparatus for forming cylindrical, conical, and annular stock materials is seen generally at 10 in FIGS. 1 and 2. With reference to these figures, it can be seen that the cutting apparatus 10 generally comprises a workpiece support assembly 30, the workpiece support assembly 30 configured to hold a workpiece (e.g., cylindrical workpiece 86 in FIG. 2) in position by means of one or more rotational attachment points, the workpiece support assembly 30 allowing generally single degree of freedom rotation while the workpiece 86 is being cut, and the workpiece support assembly 30 generally fixing the workpiece 86 in the other directions of movement during the cutting thereof; and a cutting assembly 12 having a linearly displaceable cutting blade 16, the linearly displaceable cutting blade 16 configured to tangentially engage the workpiece 86, and circumferentially cut a portion of material from the workpiece 86 (e.g., annular cut portion 87 in FIG. 12C).

In the illustrated embodiment of FIGS. 1 and 2, the workpiece support assembly 30 includes both a headstock assembly 44 and a tailstock assembly 54. The headstock assembly 44 includes a first rotational attachment point for the workpiece 86, while the tailstock assembly 54 includes a second rotational attachment point for the workpiece 86. With combined reference to FIGS. 1-3 and 7, it can be seen that the headstock assembly 44 generally comprises a horizontal base member 46, an L-shaped vertical member 48 that is mounted to a top surface of the horizontal base member 46, and a workpiece mounting means 50 that is in the form of a rotating mounting bracket (see FIG. 1). The headstock assembly 44 also includes an activation lever 52 for initiating the rotation of the workpiece 86. That is, when the activation lever 52 is depressed, the workpiece 86 will be rotated by the rotational means (e.g., an electric motor) of the headstock assembly 44. The workpiece mounting bracket 50, which is secured to the workpiece 86, rotates relative to the L-shaped vertical member 48 of the headstock assembly 44.

Figure 8:
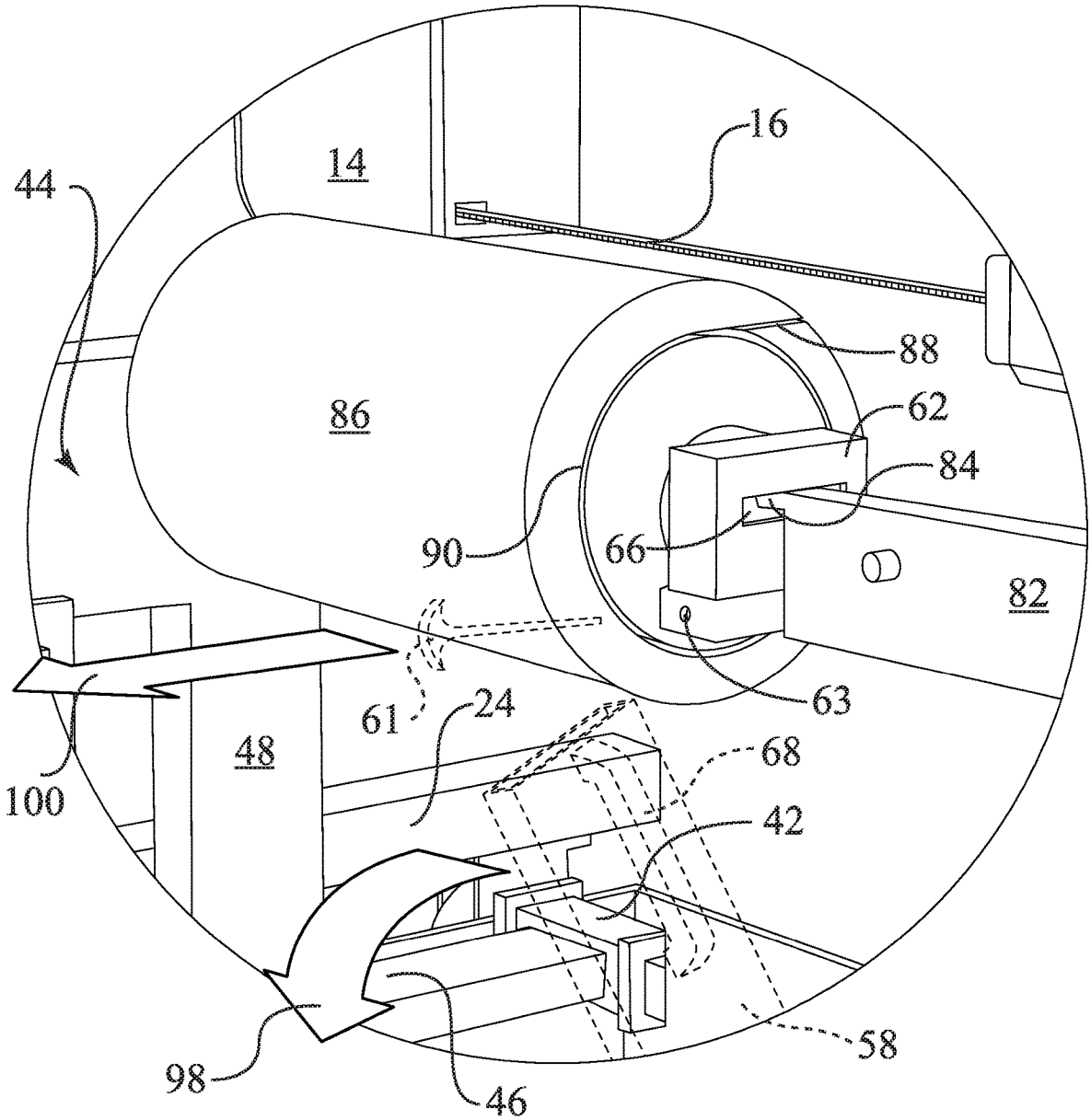
FIG. 8 is an enlarged perspective view illustrating the manner in which the swing arm assembly is hooked into the slot of the tailstock assembly, as well as the manner in which the lower section of the tailstock assembly is pivoted downwardly away from the workpiece.
Figure 9:
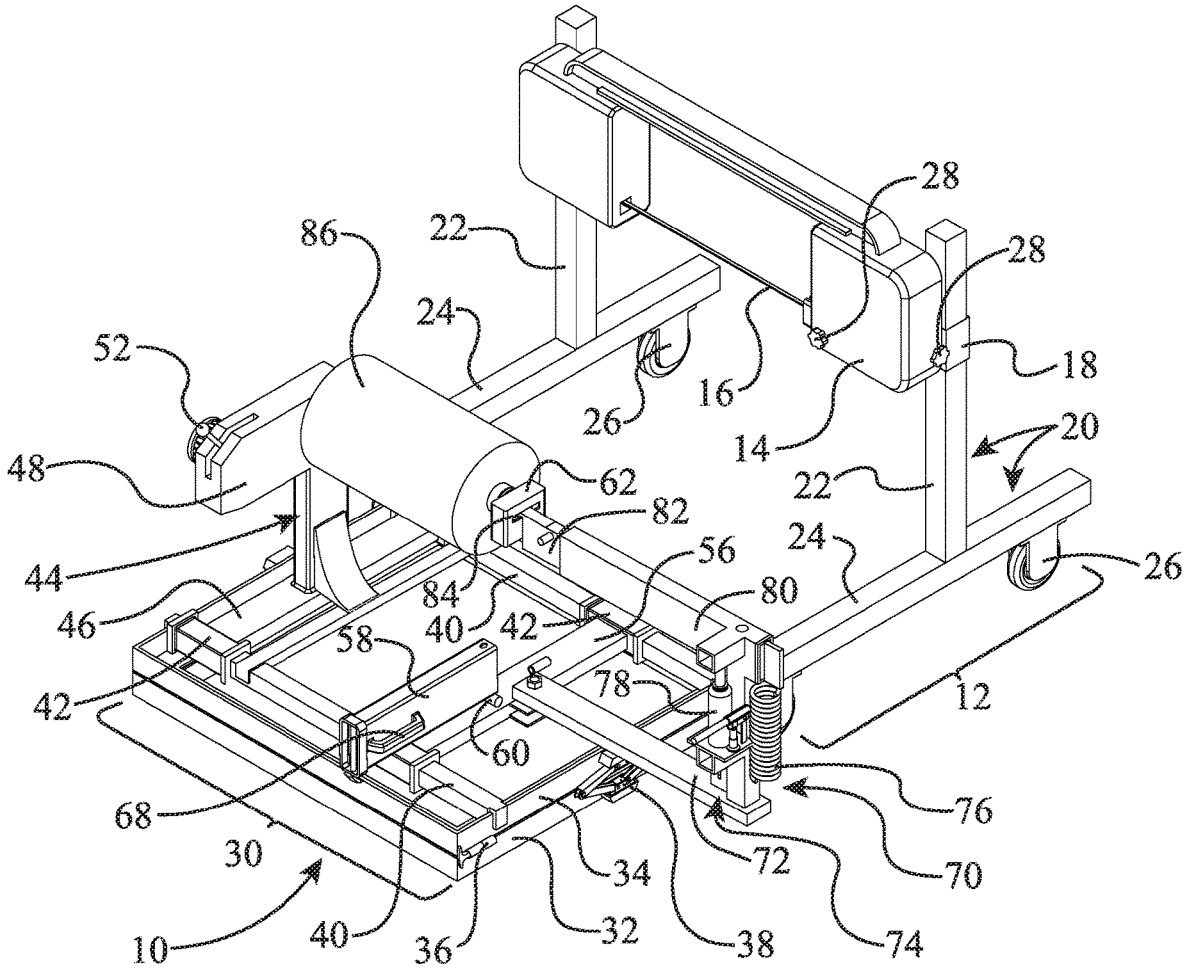
FIG. 9 is an overall perspective view illustrating the swing arm assembly being attached to the upper section of the tailstock assembly, and the lower section of the tailstock assembly in its downwardly rotated position.
Figure 10:
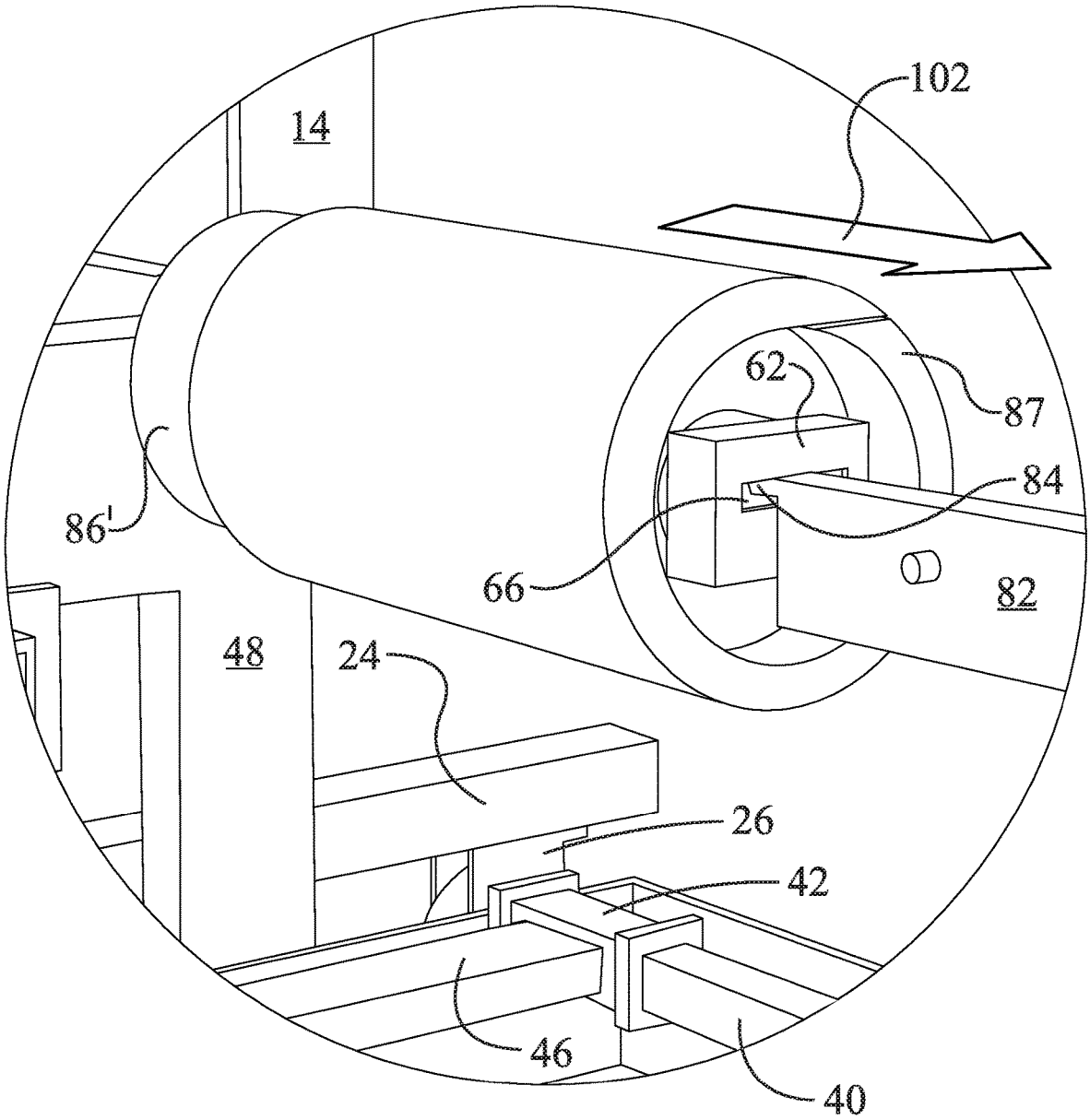
FIG. 10 is an enlarged perspective view illustrating the removal of an annular piece of cut material from the cylindrical workpiece.

Next, with combined reference to FIGS. 1-3 and 7-9, it can be seen that the tailstock assembly 54 generally comprises a horizontal base member 56, a vertical member that includes a pivotal lower section 58 and an upper section 62, and a rotating workpiece mounting means 64 (see FIG. 1). As shown in FIGS. 8 and 9, the lower section 58 of the tailstock vertical member is rotatably coupled to the horizontal base member 56 by means of a hinge member 60 (see FIG. 9). When it is desired to remove an annular cut portion 87 from the workpiece 86, the lower section 58 of the tailstock vertical member is capable of being rotated out of the way so that the annular cut portion can be removed using the swing arm assembly 70, as will be described in detail hereinafter.

As best shown in the perspective views of FIGS. 2 and 9, the oppositely disposed ends of the horizontal base member 46 of the headstock assembly 44, and the oppositely disposed ends of the horizontal base member 56 of the tailstock assembly 54, are each fixedly attached to respective adjustable mounting collars 42. The adjustable mounting collars 42, which are attached to the opposite ends of the horizontal base members 46, 56, are slidably disposed on horizontal support members 40 of the workpiece support assembly frame so that the lateral position of the headstock and tailstock assemblies 44, 54 can be selectively adjusted by a user of the cutting apparatus 10 so as to accommodate workpieces 86 of varying lengths. As shown in FIG. 9, the horizontal support members 40 are disposed generally parallel to one another, and are spaced apart from one another by the lengths of the horizontal base members 46, 56. One of the horizontal support members 40 is generally disposed in the front of the workpiece support assembly 30, while the other of the horizontal support members 40 is generally disposed in the rear of the workpiece support assembly 30.

Figure 3:
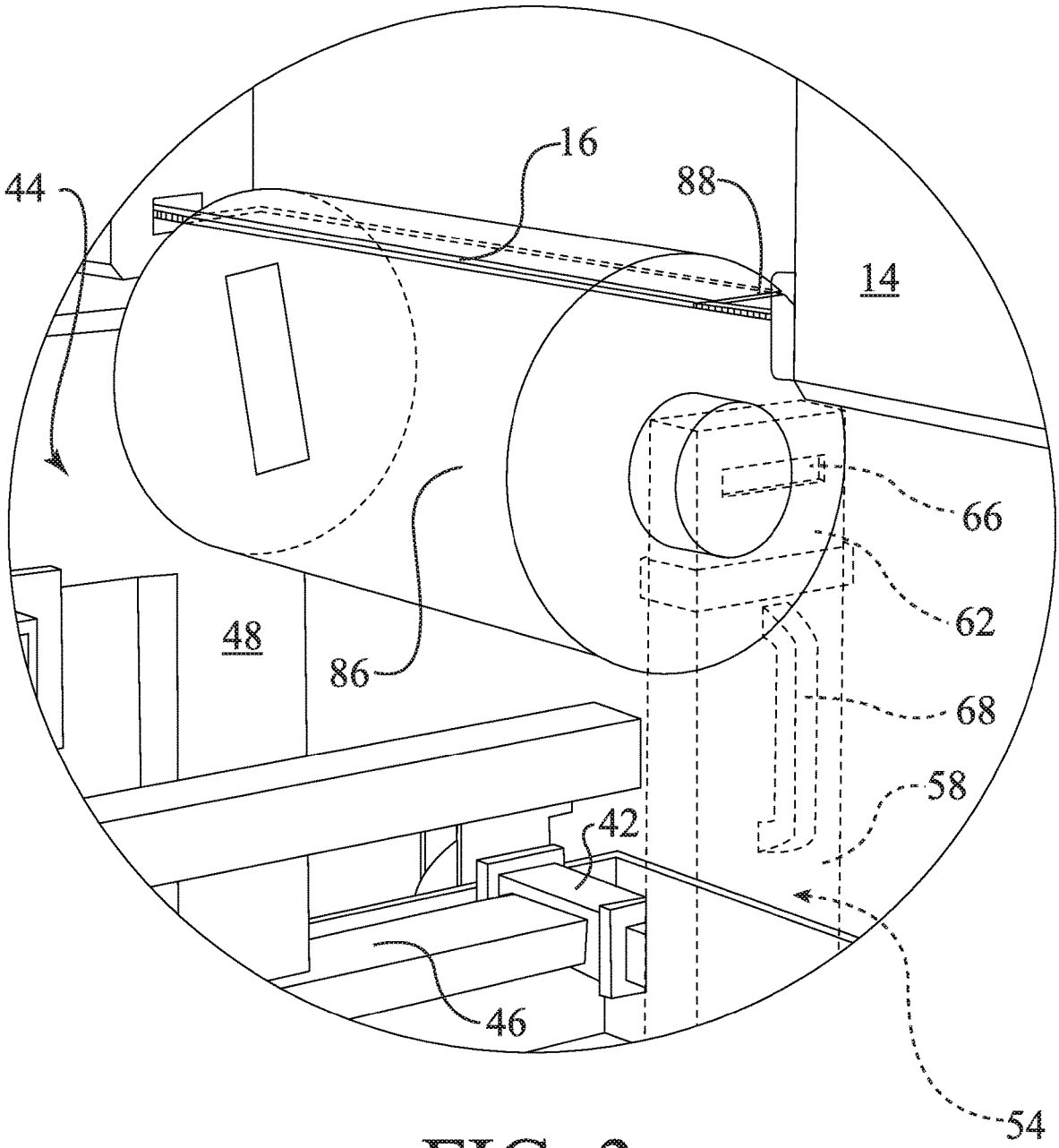
FIG. 3 is an enlarged perspective view illustrating an initial cut into the workpiece.
Figure 4:
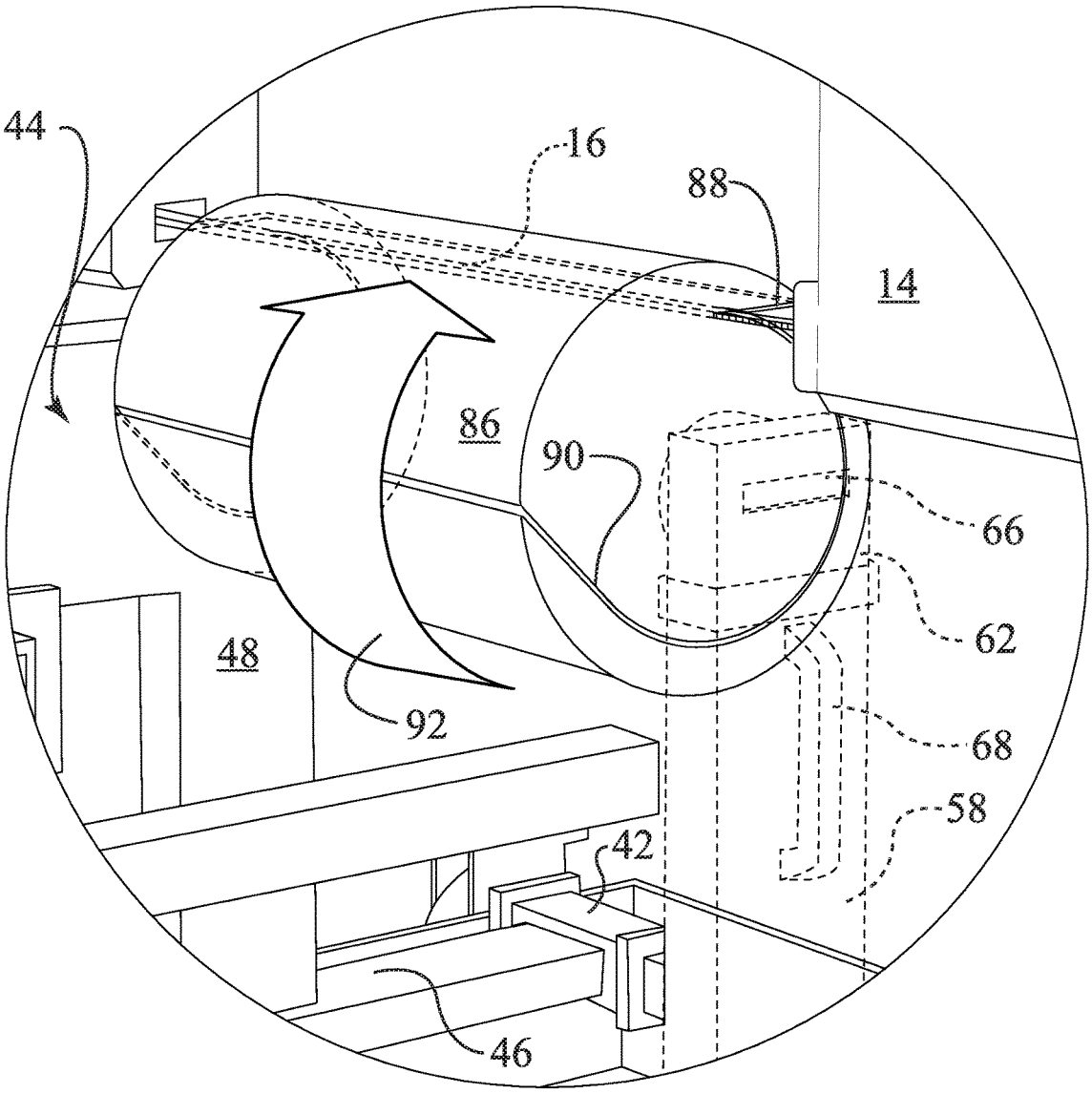
FIG. 4 is another enlarged perspective view illustrating the subsequent circumferential cut around the workpiece.
Figure 5:
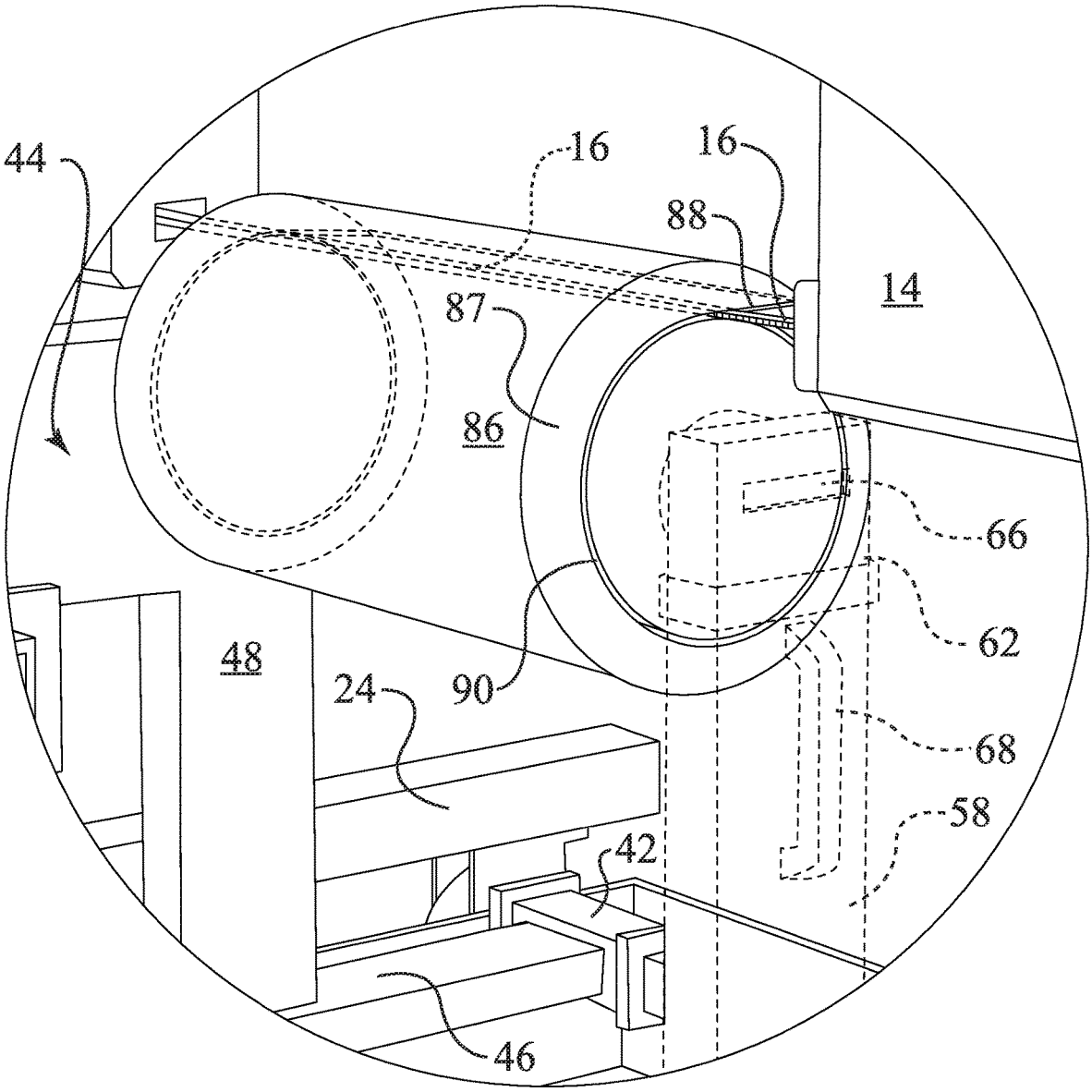
FIG. 5 is yet another enlarged perspective view illustrating the completion of the circumferential cut around the workpiece.
Figure 6:
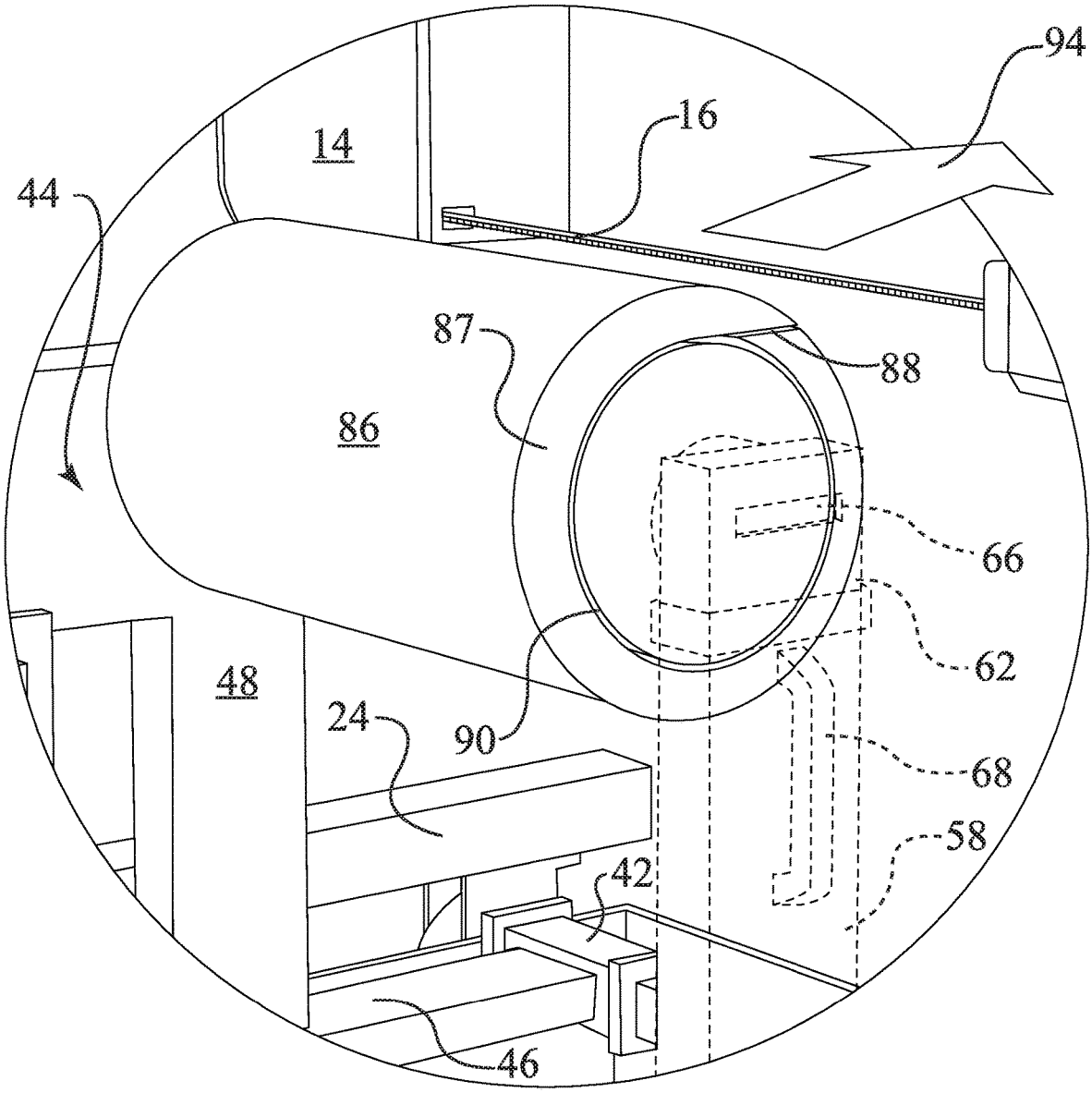
FIG. 6 is still another enlarged perspective view illustrating the removal of the cutting blade from the workpiece.
Figure 7:
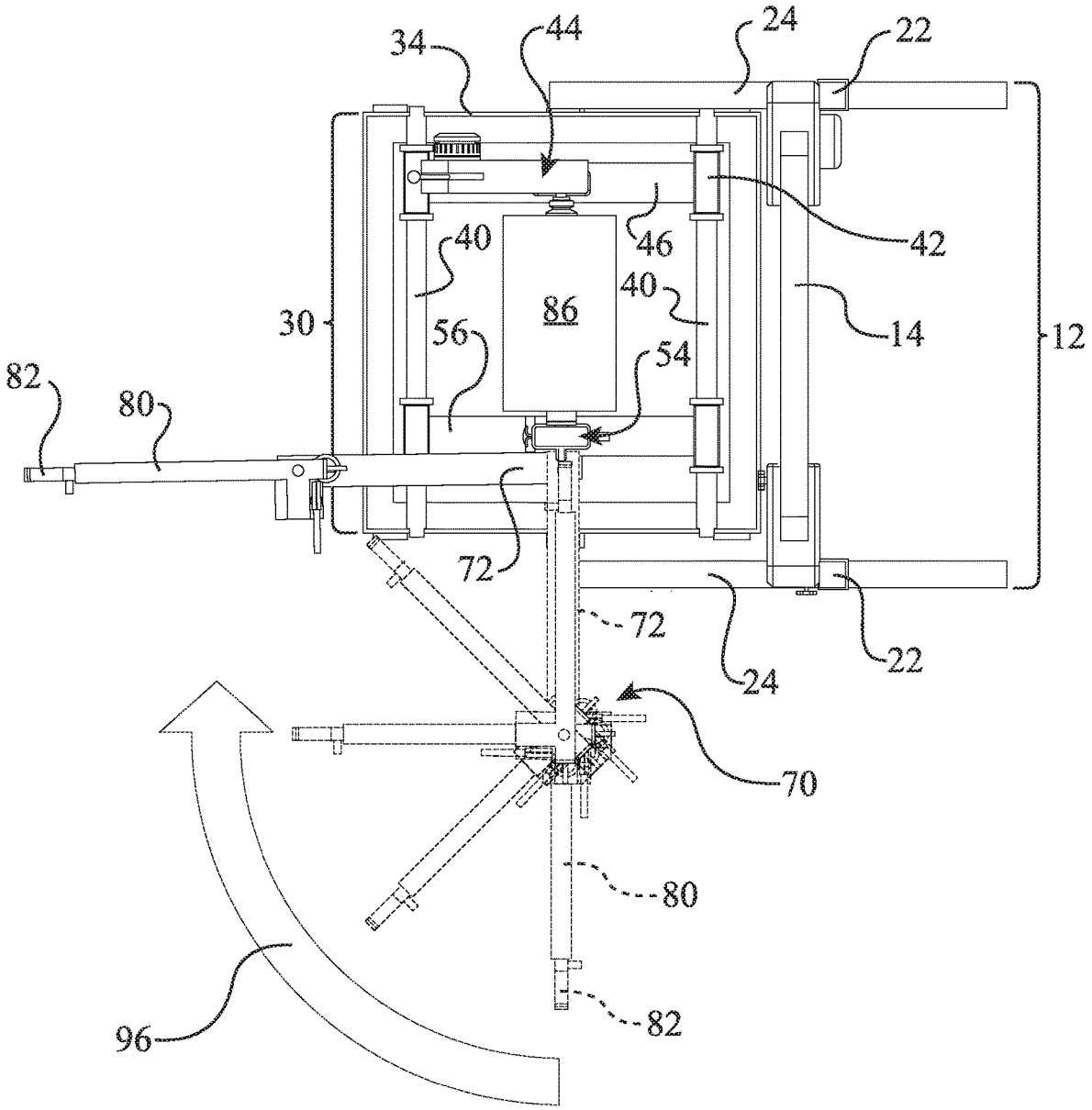
FIG. 7 is a top view of the cutting apparatus of FIG. 1, wherein the operation of the swing arm assembly is being shown.

With particular reference to FIGS. 3-6, the manner in which a workpiece 86 is cut using the cutting apparatus 10 of the illustrated embodiment will be explained in detail. In the initial stage of the cutting process (as shown in FIG. 3), the cutting blade 16 of the cutting assembly 12 makes a tangential cut 88 into the workpiece 86. Once the cutting blade 16 reaches a predetermined location in the workpiece 86, the workpiece 86 is rotated in a clockwise direction (as diagrammatically indicated by the curved arrow 92 in FIG. 4) by the workpiece support assembly 30 (e.g., by the rotational means of the headstock assembly 44). Referring to FIG. 4, it can be seen that, as the workpiece 86 is rotated, a circumferential cut 90 is made into the workpiece 86. As shown in FIG. 5, the workpiece 86 is rotated until the circumferential cut 90 reaches the location of the initial tangential cut line 88 (i.e., until the circumferential cut 90 is made approximately 360 degrees about the circumference of the workpiece 86). At this point, because the annular cut portion 87 is completely detached from the remainder of the workpiece, the cutting blade 16 is backed out of the original cutting path (e.g., using tangential cut 88) until it is no longer disposed inside the workpiece 86 (as diagrammatically indicated by the arrow 94 in FIG. 6).

Figure 12A:
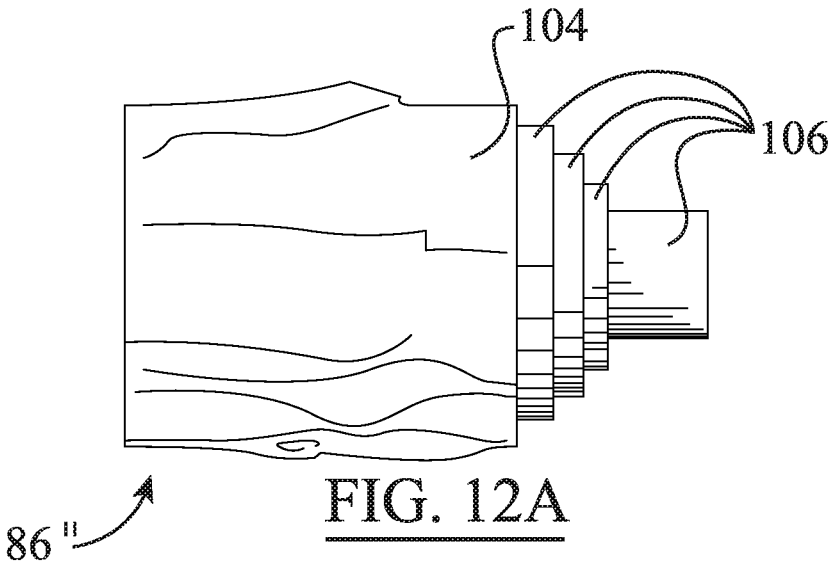
FIG. 12A is a side view of a workpiece illustrating the manner in which the workpiece can be cut into a plurality of generally concentric portions by the cutting apparatus.
Figure 12B:
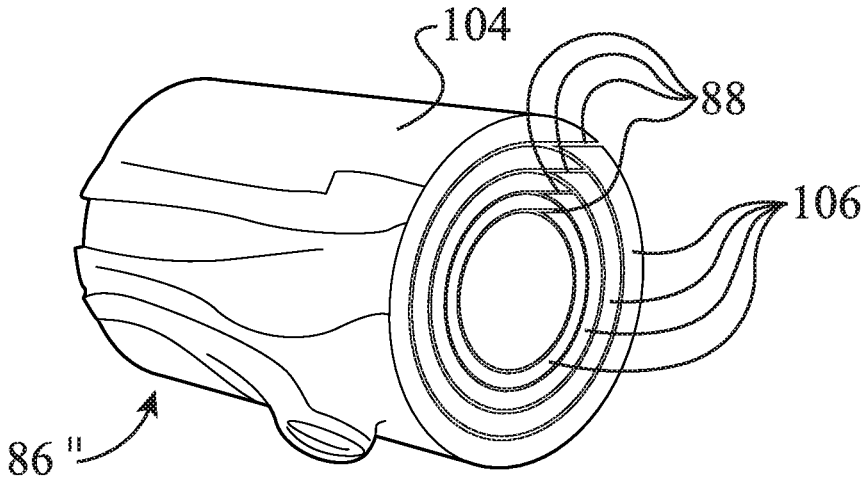
FIG. 12B is a perspective view of a workpiece illustrating the generally concentric cut lines formed by the cutting apparatus.
Figure 12C:
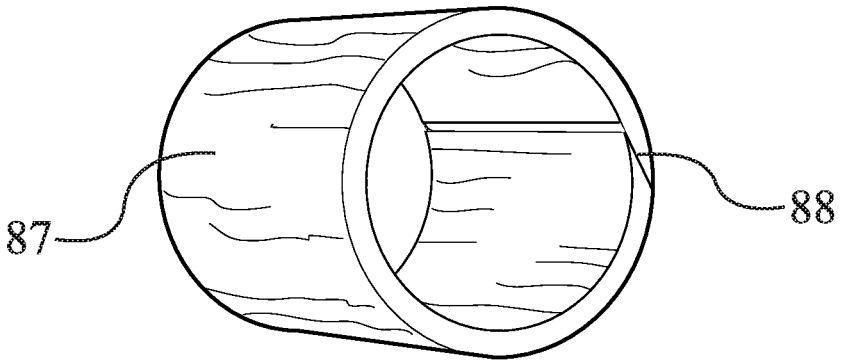
FIG. 12C is a perspective view of an annular piece of cut material that has been cut from a workpiece by the cutting apparatus.

Advantageously, as illustrated in FIGS. 12A-12C, the cutting process described above can be used to form workpieces, such as wooden logs, into a myriad of different useful shapes. Initially, referring to FIGS. 12A-12B, it can be seen that the cutting apparatus 10 described herein can be used to form a workpiece 86" with a plurality of concentric cut portions. The concentric cut portions of the workpiece 86" comprise an outer concentric portion 104 and a plurality of inner concentric portions 106. As shown in the end perspective view of FIG. 12B, each of the concentric cut portions 104, 106 comprises tangential cut line 88 where the cutting blade 16 entered into the workpiece 86". In FIG. 12C, an exemplary annular cut portion 87 with a tangential cut line 88 disposed therein is illustrated.

Now, referring to FIGS. 1, 2, and 7-11, the swing arm assembly 70 of the illustrated cutting apparatus 10 will be described in detail. In general, the swing arm assembly 70 is configured to support a portion of material (i.e., annular cut portion 87) circumferentially cut from the workpiece 86 after the portion of material 87 has been removed from the workpiece 86. Advantageously, the swing arm assembly 70 is configured to detachably engage with the tailstock assembly 54 so as to facilitate the transfer of the cut portion of material 87 from the workpiece support assembly 30 to the swing arm assembly 70. With particular reference to the perspective view of FIG. 9, it can be seen that the swing arm assembly 70 generally comprises a generally horizontal base member 72, a height adjustment means 74, an outer upper arm member 80, and an inner upper arm member 82. The inner upper arm member 82 is telescopically received within the outer upper arm member 80 so as to allow the inner upper arm member 82 to be slidably adjusted relative to the outer upper arm member 80. In one or more embodiments, a hydraulic cylinder or ram, a hydraulic screw, or another type of extendable actuating device may be used to displace the inner upper arm member 82 relative to the outer upper arm member 80. Alternatively, the inner upper arm member 82 may be manually displaced relative to the outer upper arm member 80 by a user of the cutting apparatus. The height adjustment means 74 of the swing arm assembly 70, which includes the spring member 76 and the jack subassembly 78, enables the height of the inner and outer upper arm members 80, 82 to be selectively adjusted by a user of the cutting apparatus 10 relative to the base member 72. Also, as best shown in the top view of FIG. 7, the swing arm assembly 70 is rotatably disposed relative to the workpiece support assembly 30.

Figure 11:
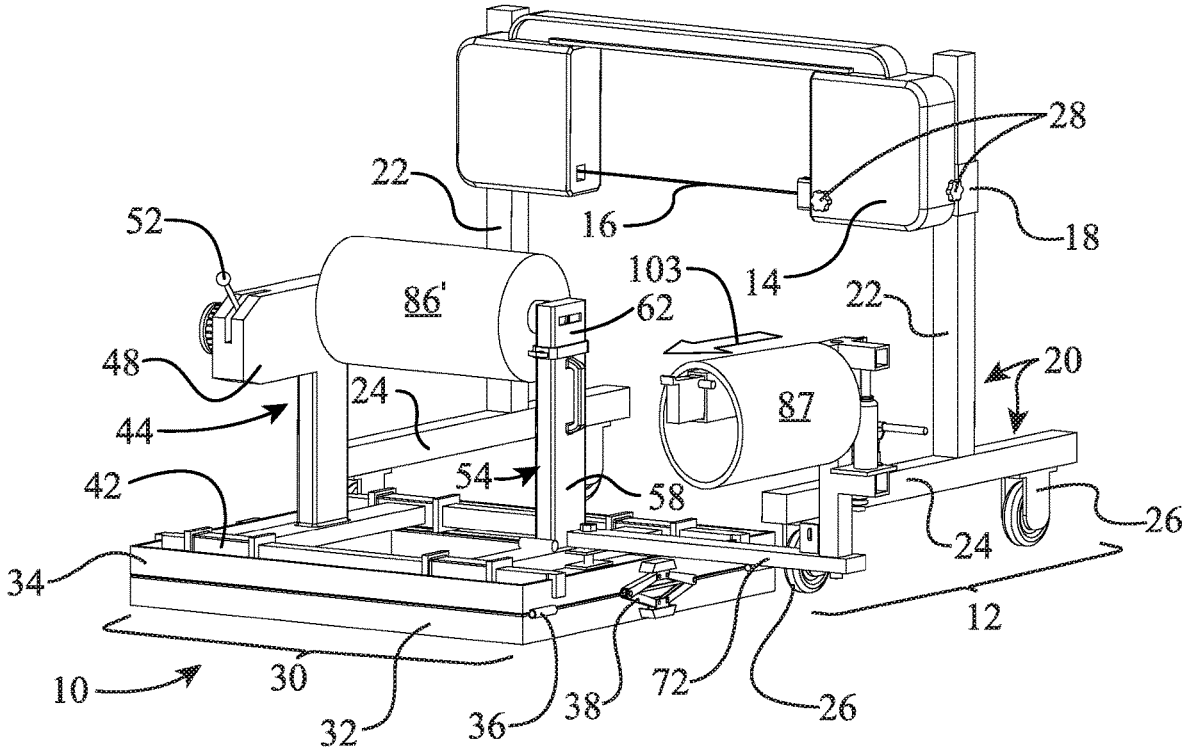
FIG. 11 is another overall perspective view illustrating the swing arm assembly detached from the tailstock assembly, and the cutting assembly rearwardly displaced from the workpiece support assembly.

Next, with reference to FIGS. 7-11, the operation of the swing arm assembly 70 of the cutting apparatus 10 will be described in detail. Once the circumferential cut 90 around the workpiece 86 has been completed (see FIG. 6), the annular cut portion 87 is no longer attached to the remainder of the workpiece 86', and can thus be removed using the swing arm assembly 70. First, referring to the top view of FIG. 7, the entire swing arm assembly 70 is rotated counterclockwise approximately 90 degrees. Then, the inner and outer upper arm members 80, 82 of the swing arm assembly 70 are rotated clockwise approximately 180 degrees (as diagrammatically indicated by the curved arrow 96 in FIG. 7) until the coupling end of the inner arm member 82 (with the L-shaped projection 84) is disposed proximate to the tailstock assembly 54 of the cutting apparatus 10. Once the inner and outer upper arm members 80, 82 have been rotated, the L-shaped projection 84 on the distal end of the inner arm member 82 is detachably coupled to the elongated slot 66 in the side of the upper section 62 of the tailstock vertical member (see FIG. 8). After which, the pivotable lower section 58 of the tailstock vertical member can be rotated out of the way to clear the path for the removal of the annular cut portion 87. To rotate the lower section 58 of the tailstock vertical member, the user first removes the pin 61 that secures the lower section 58 of the tailstock vertical member to the upper section 62 from its aperture 63 in the bottom of the upper section 62 (the direction of pin removal is diagrammatically indicated by the arrow 100 in FIG. 8). Then, the user grasps the handle 68 on the pivotable lower section 58 and rotates it downwardly approximately 90 degrees (about its hinge member 60) until the lower section 58 rests on the front horizontal member 40 of the base frame in a generally horizontal position (refer to FIG. 9). The rotation of the pivotable lower section 58 of the tailstock vertical member is diagrammatically indicated by the curved arrow 98 in FIG. 8. Now that the lower section 58 of the tailstock assembly 54 has been rotated out of the way, referring to FIG. 10, it can be seen that the annular cut portion 87 can be separated from the remainder of the workpiece 86' by sliding the annular cut portion 87 in an axial direction (as diagrammatically indicated by the arrow 102 in FIG. 10) onto the inner and outer arm members 80, 82 of the swing arm assembly 70. Then, after the annular cut portion 87 is completely disposed on the arm members 80, 82 of the swing arm assembly 70, the L-shaped projection 84 on the distal end of the inner arm member 82 can be detached from the elongated slot 66 in the side of the upper section 62, and the swing arm assembly 70 can be rotated out of the way and into a position, such as that which is depicted in FIG. 11. Finally, the user can unload the annular cut portion 87 from the swing arm assembly 70 by sliding it off the end thereof (as diagrammatically indicated by the arrow 103 in FIG. 11).

It is apparent from the description of the cutting process provided above that the workpiece 86 rotates about a rotational axis while being cut. In the cutting process described in conjunction with FIGS. 3-6 above, the rotational axis of the workpiece 86 is disposed generally parallel to a longitudinal extending direction of the linearly displaceable cutting blade 16. Although, it is to be understood that the adjustability of the base frame of the workpiece support assembly 30 also allows the rotational axis of the workpiece 86 to be disposed at an acute angle relative to a longitudinal extending direction of the linearly displaceable cutting blade 16. The components of the base frame of the workpiece support assembly 30 that make angled cutting of the workpiece 86 possible will be described hereinafter.

Referring to FIGS. 1, 2, and 16-19, it can be seen that the base frame of the workpiece support assembly 30 includes a lower base frame section 32 and an upper base frame section 34. The upper base frame section 34 is pivotally coupled to the lower base frame section 32 so as to enable the linearly displaceable cutting blade 16 to cut the workpiece 86 at an angle relative to a rotational axis of the workpiece 86 (e.g., see FIG. 17). As best shown in FIGS. 1 and 2, the upper base frame section 34 is pivotally coupled to the lower base frame section 32 by means of a plurality of hinge members 36. In the illustrated embodiment, a pair of hinge members 36 are disposed on each of two opposite sides of the upper and lower base frame sections 32, 34 (e.g., see FIGS. 1, 2, and 16). Each pair of hinge members 36 comprises spaced apart hinge members 36, which are each disposed near a respective corner of the upper and lower base frame sections 32, 34. Also, each of the hinge members 36 is in the form of a barrel hinge with a removable pin member 118. Also, as shown in the illustrated embodiment of FIGS. 1, 2, and 16-19, the workpiece support assembly 30 of the cutting apparatus 10 additionally comprises scissor jack subassemblies 38 disposed on two opposite sides of the upper and lower base frame sections 32, 34. As depicted in FIGS. 16-19, each of the scissor jack subassemblies 38 is configured to elevate a side of the upper base frame section 34 above a respective side of the lower base frame section 32, thereby forming a gap between the side of the upper base frame section 34 and the side of the lower base frame section 32.

Figure 17:
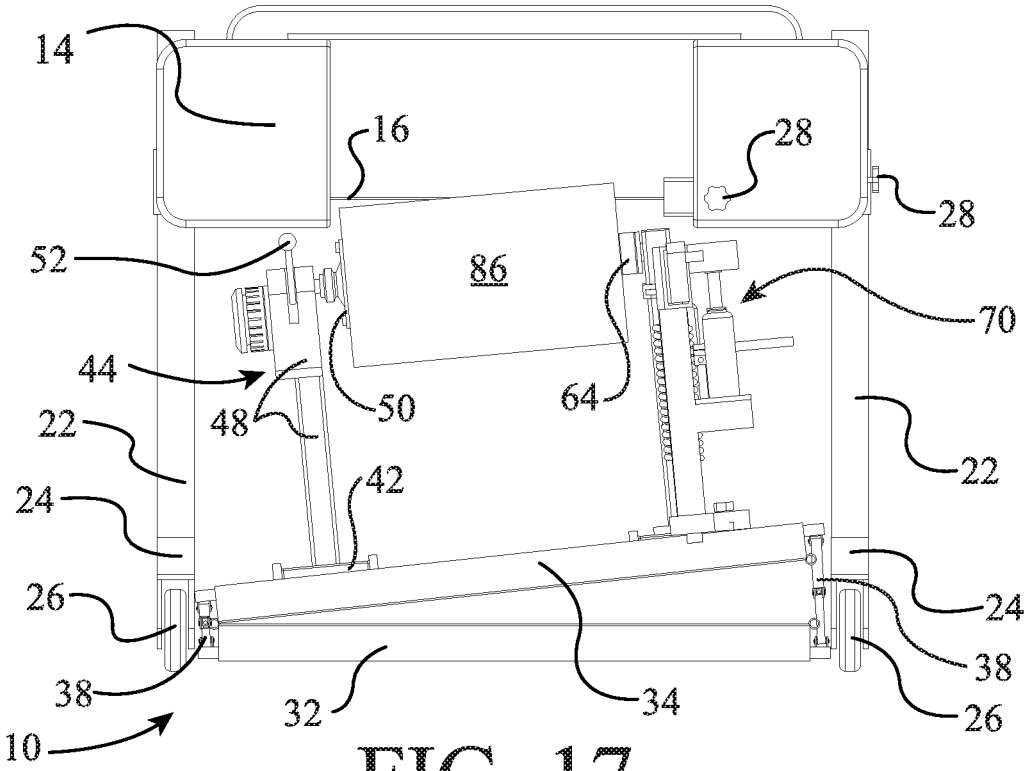
FIG. 17 is a front view of the cutting apparatus illustrating a first angle cut into a workpiece.
Figure 18:
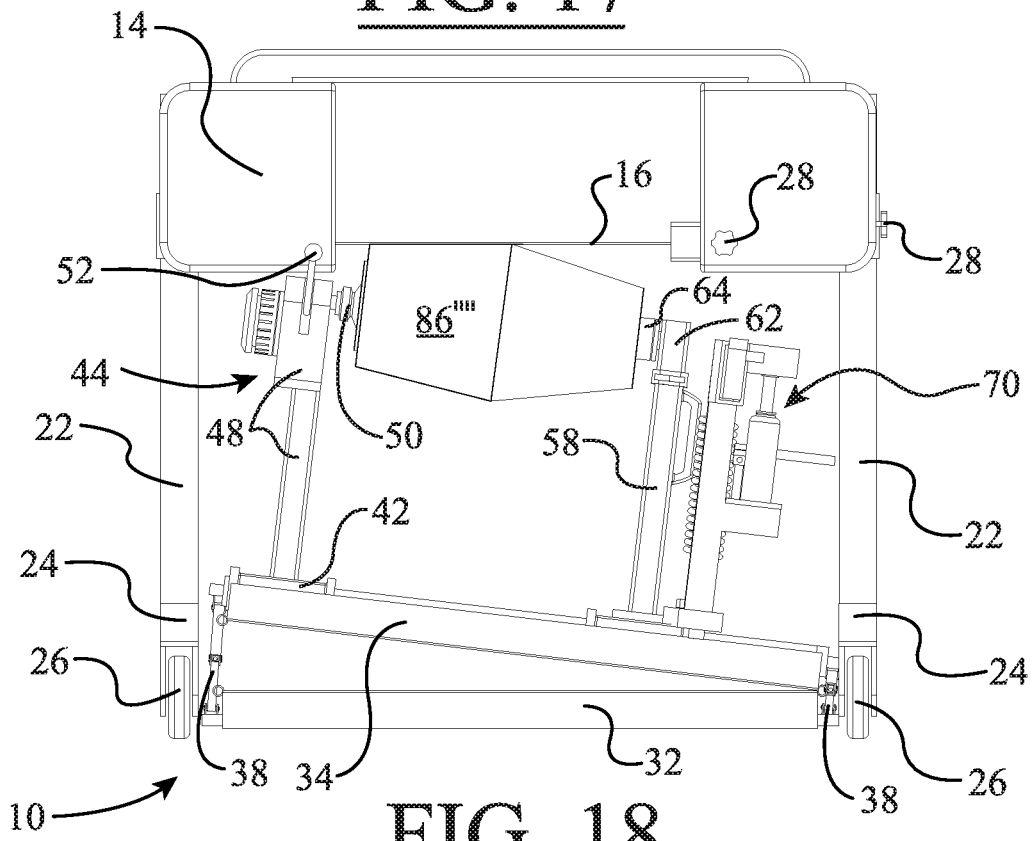
FIG. 18 is a front view of the cutting apparatus illustrating a second angle cut into a workpiece.
Figure 19:
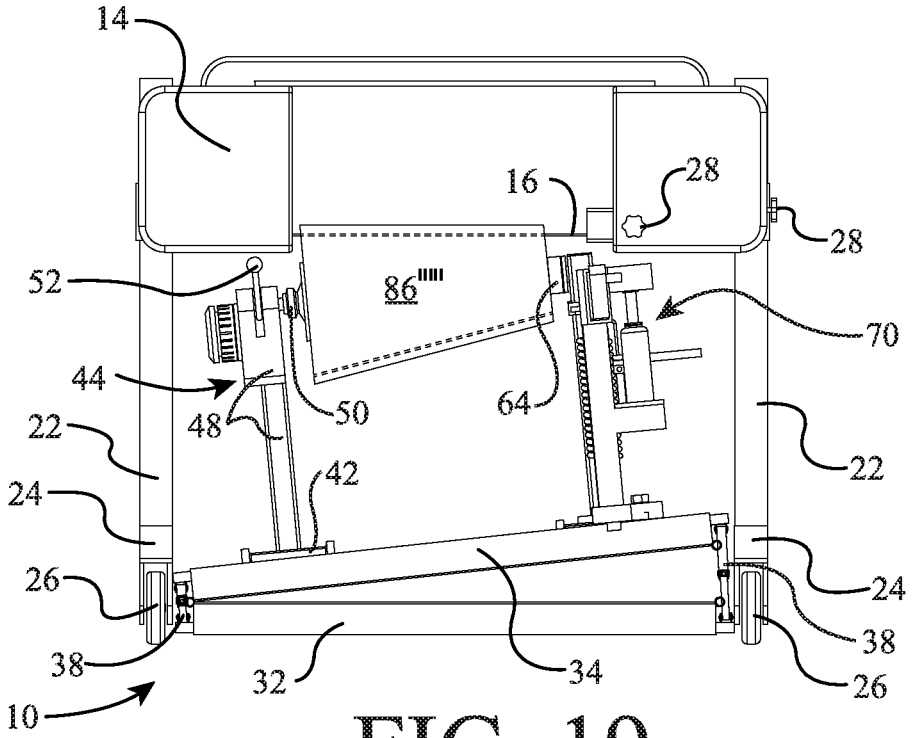
FIG. 19 is a front view of the cutting apparatus illustrating a tapered cut about the circumference of a workpiece.
Figure 20:
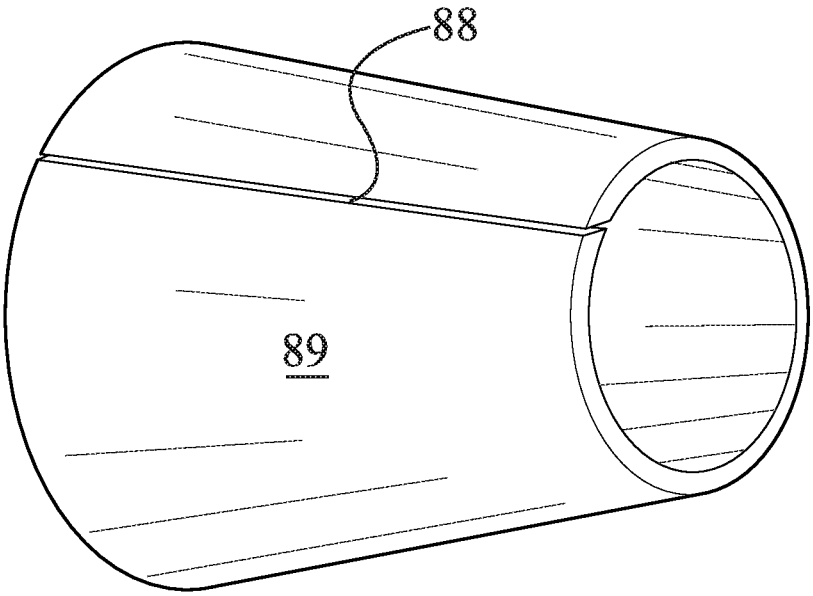
FIG. 20 is a perspective view of a conical piece of cut material that has been cut from a workpiece by the cutting apparatus when a tapered cut is made about the circumference of the workpiece.

When a user wants to use the cutting apparatus 10 to create an angled cut into a workpiece 86, he or she simply releases the pins 118 in the side of the workpiece support assembly base frame that needs to be elevated, and then, uses the scissor jack subassembly 38 disposed on that side of the base frame to elevate the upper base frame section 34 above the lower base frame section 32. This allows the user to make an angled cut into the workpiece 86. As shown in FIGS. 17 and 19, the angle cut can be done in a single direction so as to create a conical annular cut portion 89 from a conical workpiece 86''''. Alternatively, as illustrated in FIG. 18, the angled cut can be done in two directions so as to form a workpiece 86'''' having a double conical shape.

Next, with particular reference to FIGS. 1, 2, and 11, the cutting assembly 12 of the cutting apparatus 10 will be described in detail. As shown in these figures, the cutting assembly 12 of the illustrated embodiment comprises a band saw 14 with a cutting blade 16 that is displaced in a generally linear manner (e.g., by rotating the cutting blade 16 within the housing of the band saw 14). The band saw 14 is provided with a plurality of adjustment knobs 28 disposed thereon. One of the adjustment knobs 28 is used to adjust the tension of the band saw cutting blade 16, while the other of the knobs 28 is used to adjust height of the band saw 14 on the upright support post members 22. It can be seen that the cutting assembly 12 additionally comprises a support frame 20 with opposed, generally horizontal base frame members 24 that are respectively attached to opposed, generally upright support post members 22. In the illustrated embodiment, each of the opposed base frame members 24 includes a pair of wheel assemblies 26 for enabling the cutting assembly 12 to be displaced relative to the workpiece support assembly 30. As shown in FIGS. 1 and 2, the wheel assemblies 26 in each pair are disposed on generally opposite ends of the base frame members 24. Turning again to FIGS. 1, 2, and 11, it can be seen that the band saw 14 is adjustably supported on opposed upright support post members 22 by means of adjustable mounting collars 18. When the knob(s) 28 disposed on one or more lateral sides of the band saw 14 are loosened, the mounting collars 18 are capable of sliding in a generally vertical direction relative to the upright support post members 22 so that the height of the band saw 14 can be adjusted relative to the ground.

Figure 13:
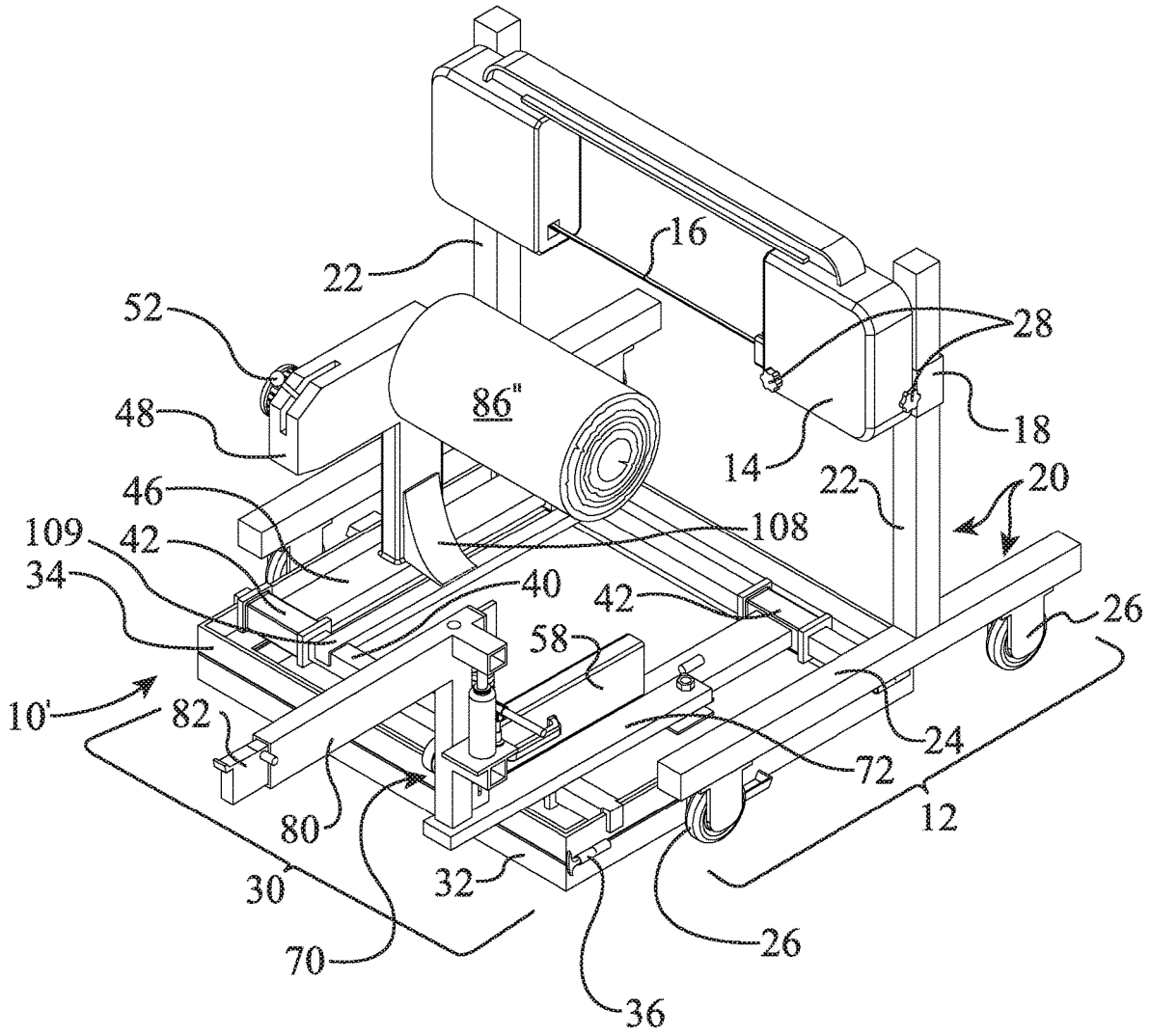
FIG. 13 is a front-right perspective view of the cutting apparatus wherein the workpiece is supported only by the headstock assembly.
Figure 14:
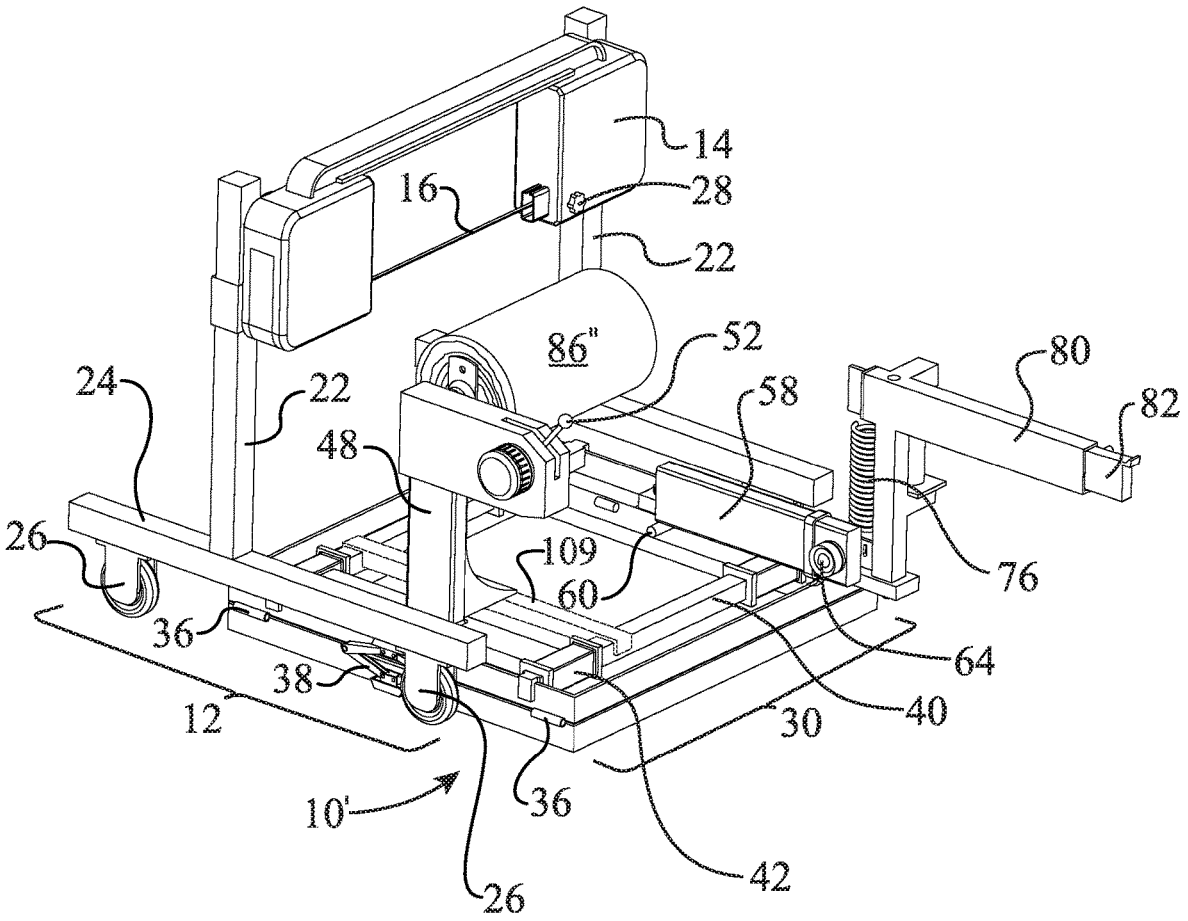
FIG. 14 is a left-front perspective view of the cutting apparatus wherein the workpiece is supported only by the headstock assembly.
Figure 15:
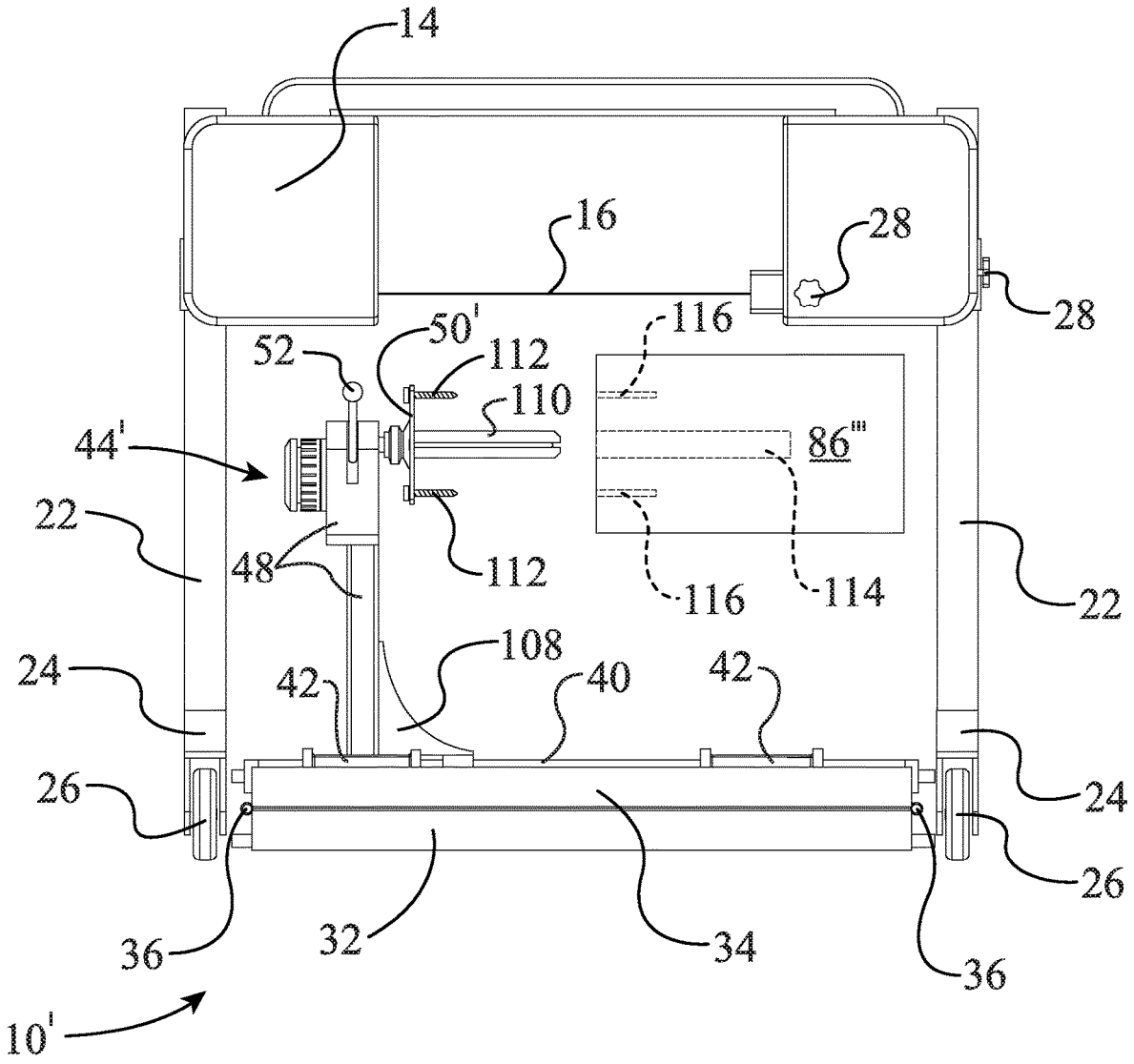
FIG. 15 is a front view of the cutting apparatus illustrating the additional hardware that can be added to the headstock assembly when it is used to support the workpiece without the tailstock assembly.
Figure 16:
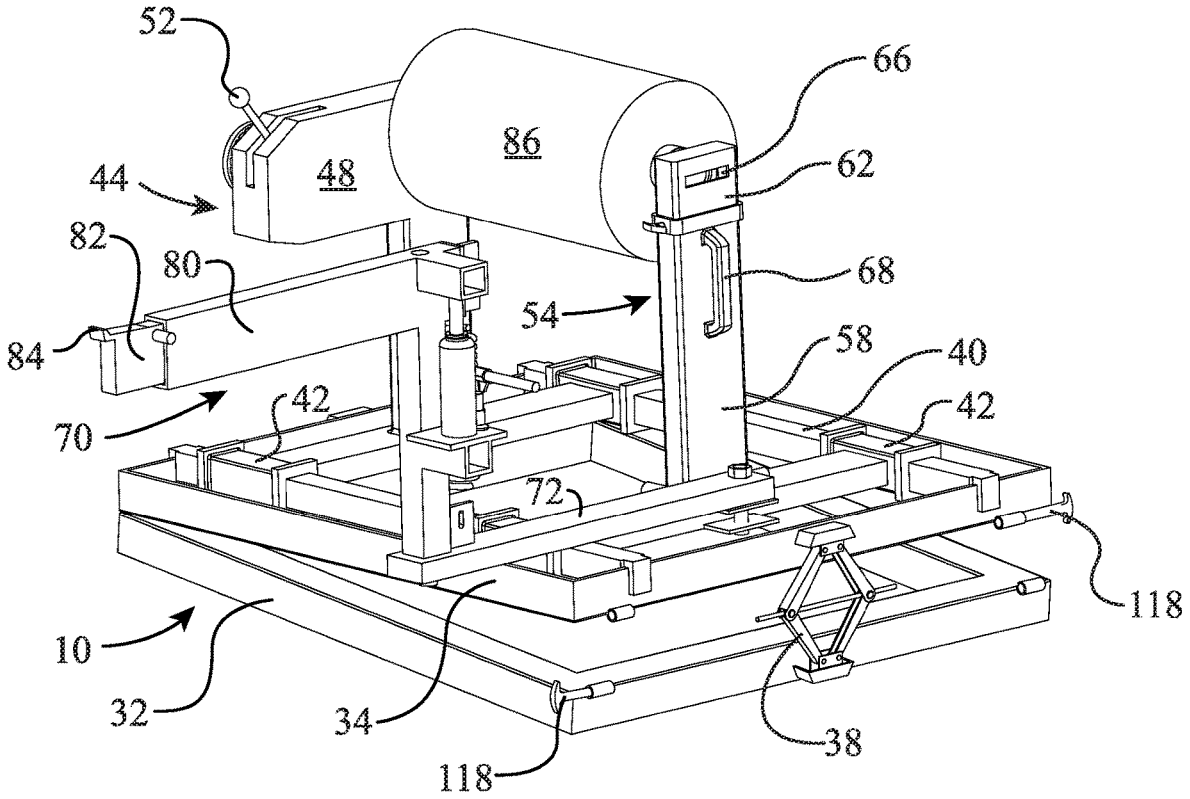
FIG. 16 is a perspective view of the workpiece support assembly of the cutting apparatus, wherein the workpiece support assembly is in a tilted position for facilitating an angle cut into the workpiece.

A second exemplary embodiment of the cutting apparatus is seen generally at 10' in FIGS. 13-15. Referring to these figures, it can be seen that, in many respects, the second exemplary embodiment is similar to that of the first embodiment. Moreover, many elements are common to both such embodiments. For the sake of brevity, the elements that the second embodiment of the cutting apparatus has in common with the first embodiment will not be discussed because these components have already been explained in detail above. Furthermore, in the interest of clarity, these elements are denoted using the same reference characters that were used in the first embodiment.

In the second exemplary embodiment, as shown in FIGS. 13-15, the workpiece 86'' is being supported only by using the headstock assembly 44' of the cutting apparatus 10'. As shown in these figures, the workpiece 86'' is being supported without use of the tailstock assembly 54 at all. As best shown in FIG. 14, both the upper and lower sections 58, 62 of the tailstock assembly 54 are rotated downwardly approximately 90 degrees (about the hinge member 60) such that they are just resting on the base member 56 and the front mounting collar 42. Thus, the tailstock assembly 54 is inactive in the second embodiment, and does not bear any of the weight of the workpiece 86''. Rather, the workpiece 86'' is supported in a cantilevered manner from the headstock assembly 44'. As best shown in FIGS. 13 and 15, the headstock assembly 44' is provided with supplemental support members 108, 109 in the second illustrative embodiment to compensate for the additional forces exerted on the headstock assembly 44' by the weight of the workpiece 86''. In particular, the supplemental support members 108, 109 compensate for the moment exerted on the base portion of the L-shaped vertical member 48 by the cantilevered mounting arrangement of the workpiece 86'' in the second embodiment. As shown in FIG. 15, the supplemental support member 108 couples the base portion of the L-shaped vertical member 48 to the generally horizontal, supplemental support member 109. In FIGS. 13 and 14, it can be seen that the supplemental support member 109 straddles the parallel support members 40 of the workpiece support assembly 30. Also, as shown in these figures, the supplemental support member 109 is provided with bent edge portions that wrap around the sides of each support member 40.

Turning to FIG. 15, it can be seen that, in the second illustrative embodiment, the workpiece mounting means 50' of the headstock assembly 44' also is provided with additional hardware in order to help support the load of the workpiece 86'', 86''' that is being carried exclusively by the headstock assembly 44'. In particular, workpiece mounting means 50' comprises central plunger 110, which is flanked on opposite sides by the mounting screws 112. Once the plunger 110 is inserted into a central bore 114 of the workpiece 86''', it can be outwardly expanded so as to secure the workpiece 86''' to the headstock assembly 44' of the cutting apparatus 10'. Also, the mounting screws 112 of the workpiece mounting means 50' are screwed into small bores 116 of the workpiece 86''' so as to additionally secure the workpiece 86''' to the headstock assembly 44'.

Figure 21:
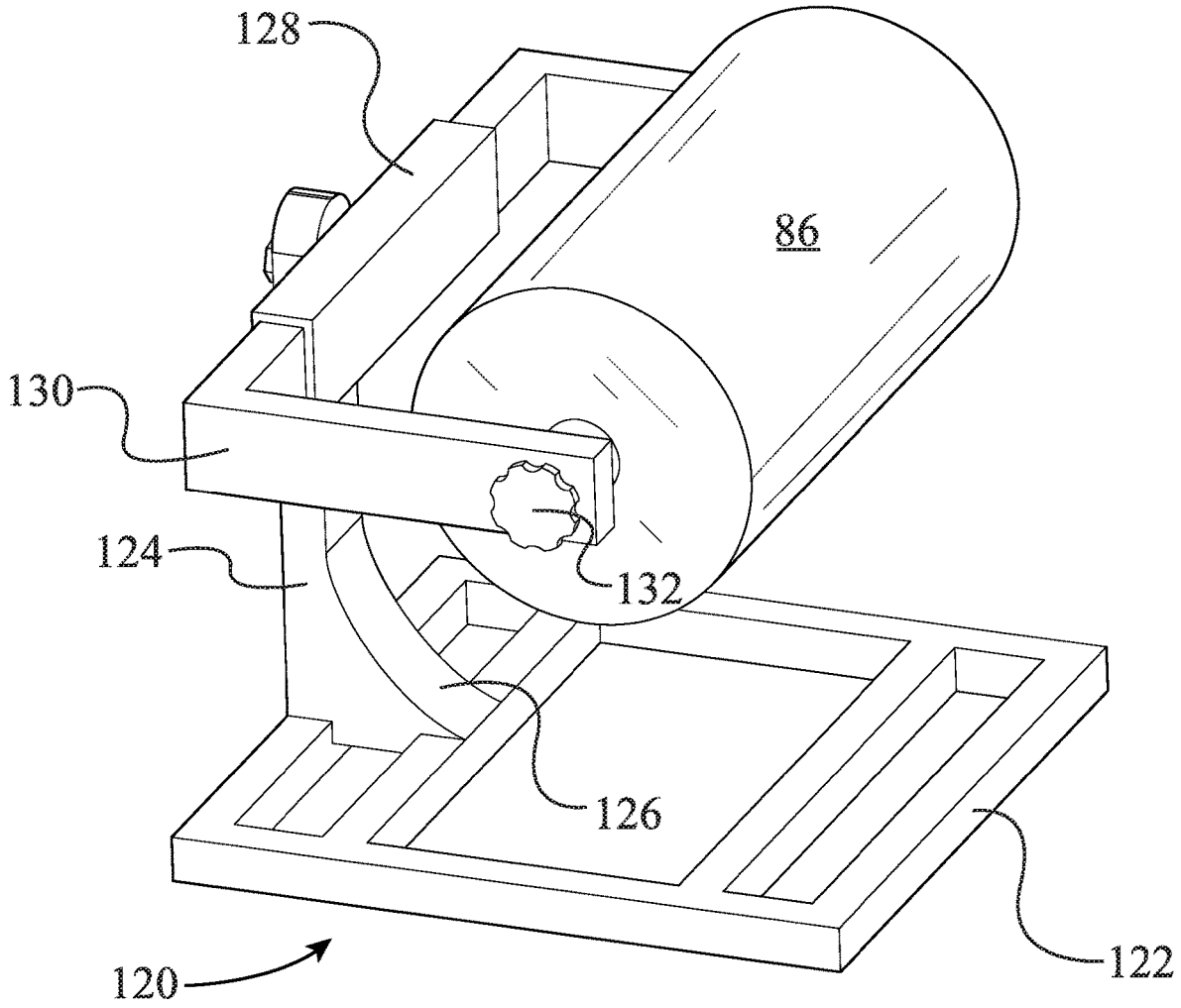
FIG. 21 is a side perspective view of an alternative workpiece support assembly of the cutting apparatus, wherein the workpiece support assembly is in the form of a single post, cantilever-type support assembly.
Figure 22:
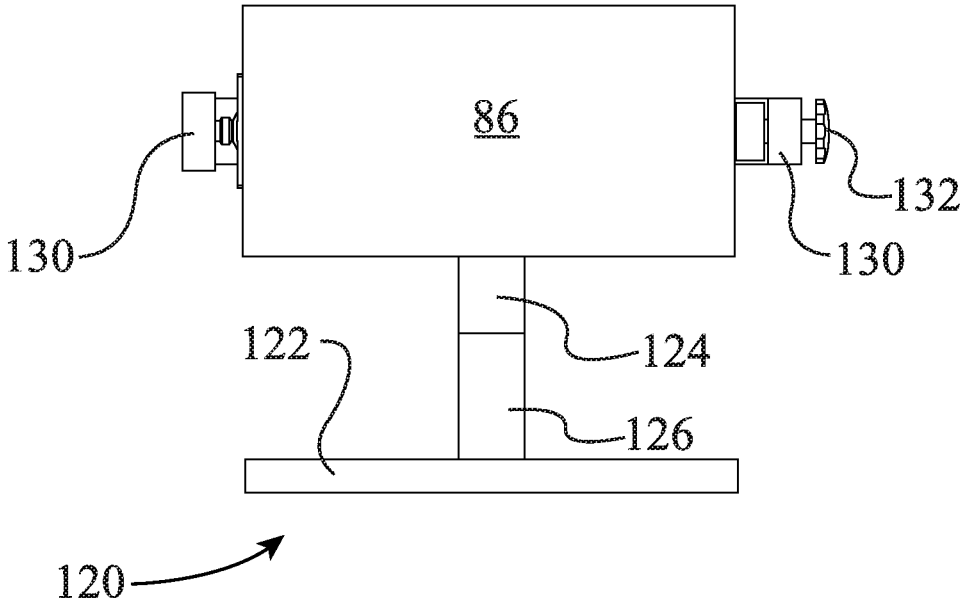
FIG. 22 is a front view of the alternative workpiece support assembly, wherein a yoke of the single post, cantilever-type support assembly is disposed in a generally horizontal position for making a straight cut into a workpiece.
Figure 23:
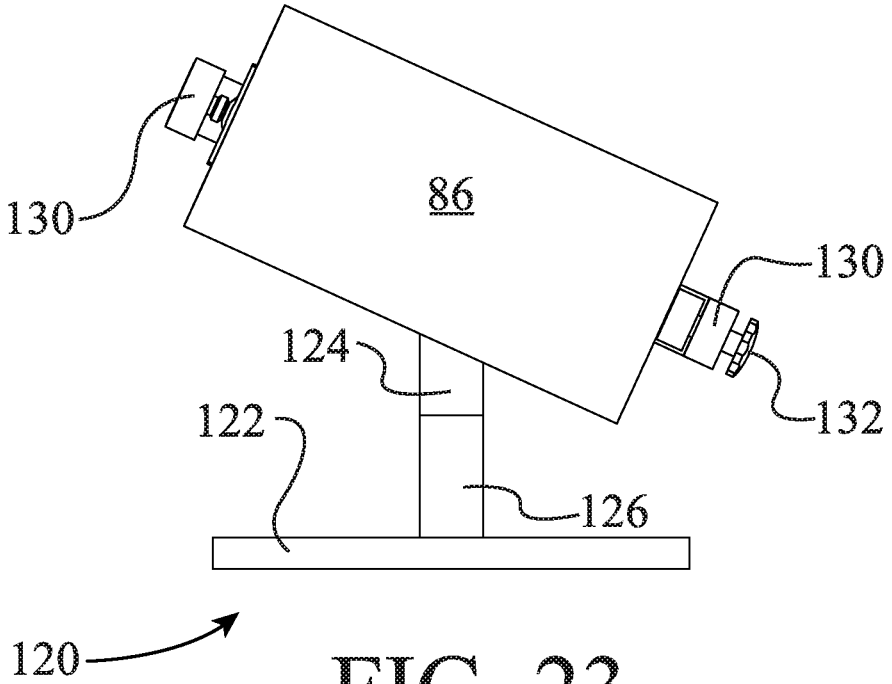
FIG. 23 is a front view of the alternative workpiece support assembly, wherein the yoke of the single post, cantilever-type support assembly is disposed in a tilted position for making an angled cut into a workpiece.

In a third exemplary embodiment, with reference to FIGS. 21-23, the workpiece support assembly 30 of the cutting apparatus 10 comprises a single post, cantilever-type workpiece holder 120, rather than the headstock and tailstock assemblies 44, 54 described above with regard to the first two embodiments. Initially, referring to the perspective view of FIG. 21, it can be seen that the single post, cantilever-type workpiece holder 120 generally includes a base frame 122, a single upright post member or stanchion member 124 attached to the base frame assembly 122, and a workpiece retention yoke 130 that is rotatably connected to the stanchion member 124. It can be seen that the workpiece retention yoke 130 is configured to support a workpiece 86 in a cantilevered manner above the base frame 122 of the single post, cantilever-type workpiece holder 120. Also, as shown in FIGS. 21-23, the base portion of the stanchion member 124 is provided with a supplemental support member 126 for added strength, which is similar to the supplemental support member 108 described above with regard to the second embodiment. As best shown in FIG. 21, the workpiece retention yoke 130 is attached to the stanchion member 124 by means of a yoke sleeve 128. One or more ends of the workpiece retention yoke 130 are provided with an adjustment knob 132 for axially securing the workpiece 86 in place within the yoke 130.

Advantageously, the workpiece retention yoke 130 is rotatably adjustable relative to the stanchion member 124 so as to enable the linearly displaceable cutting blade 16 to cut the workpiece 86 at an angle relative to a rotational axis of the workpiece 86 (e.g., see FIG. 23). Thus, by adjusting the rotational position of the yoke 130 relative to the stanchion member 124, the workpiece 86 can be oriented in a generally horizontal position for a straight cut (as shown in FIG. 22), or in a tilted position for an angled cut (as shown in FIG. 23).

Figure 24:
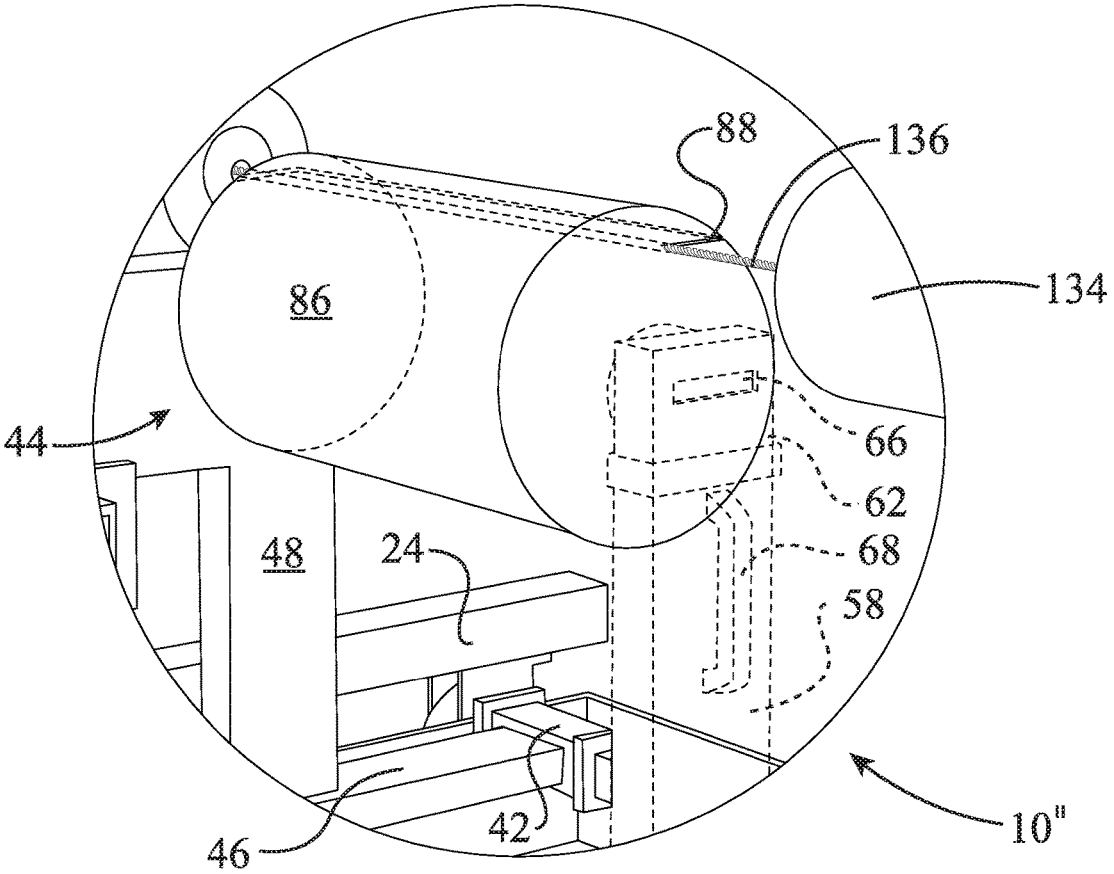
FIG. 24 is an enlarged perspective view illustrating an alternative rotary cutting assembly making an initial cut into a workpiece.
Figure 25:
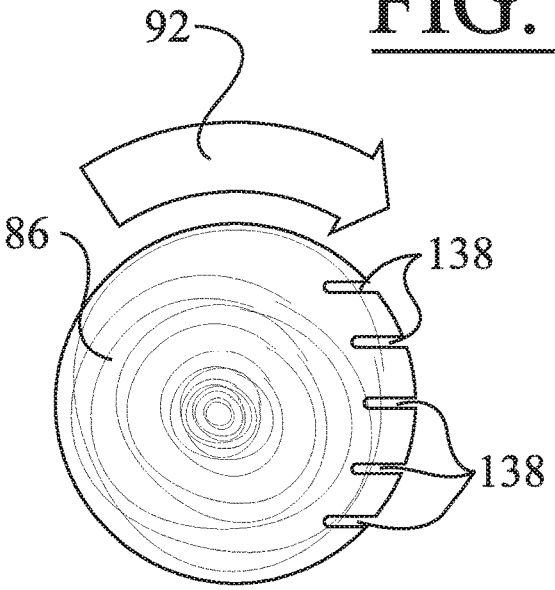
FIG. 25 is an end view of a workpiece illustrating a plurality of lateral cuts that have been made into the workpiece using the alternative rotary cutting assembly.
Figure 26:
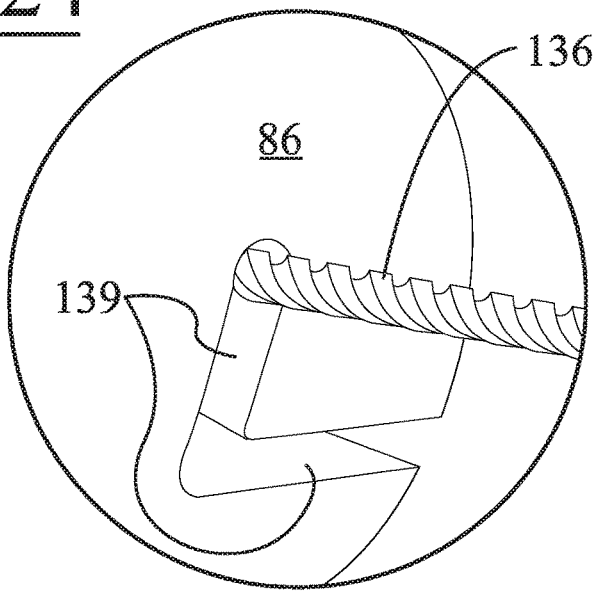
FIG. 26 is an enlarged perspective view of a workpiece illustrating an L-shaped cut that has been made into the workpiece using the alternative rotary cutting assembly.

A fourth exemplary embodiment of the cutting apparatus is seen generally at 10" in FIGS. 24-26. Referring to these figures, it can be seen that, in many respects, the fourth exemplary embodiment is similar to that of the preceding three embodiments. Moreover, many elements are common to all of the embodiments. For the sake of brevity, the elements that the fourth embodiment of the cutting apparatus 10" has in common with the preceding embodiments will not be discussed because these components have already been explained in detail above. Furthermore, in the interest of clarity, these elements are denoted using the same reference characters that were used in the preceding three embodiments.

In the fourth exemplary embodiment, as shown in the enlarged perspective view of FIG. 24, the cutting device comprises a rotary drill 134, rather than the band saw 14 that was described in conjunction with the preceding three embodiments. In FIG. 24, it can be seen that the rotary drill bit 136 of the rotary drill 134 can be used to make a tangential cut 88 into the workpiece 86, similar to that which was described above with regard to the cutting blade 16 of the band saw 14. After making the initial tangential cut 88 into the workpiece 86, the workpiece 86 is then rotated in order to make a circumferential cut around the periphery of the workpiece 86 (e.g., as diagrammatically indicated by the curved arrow 92 in FIG. 25). The circumferential cut made by the rotary drill 134 is similar to that described above for the band saw 14. As shown in FIG. 25, the rotary drill 134 can be used to make lateral cuts 138 into the workpiece 86 at almost any location on the side of the workpiece 86. Also, as illustrated in the detailed view of FIG. 26, the rotary drill 134 is also capable of making an L-shaped cut 139 into the workpiece 86, which is not really possible with the linearly displaceable cutting blade 16 of the band saw 14.

Figure 27:
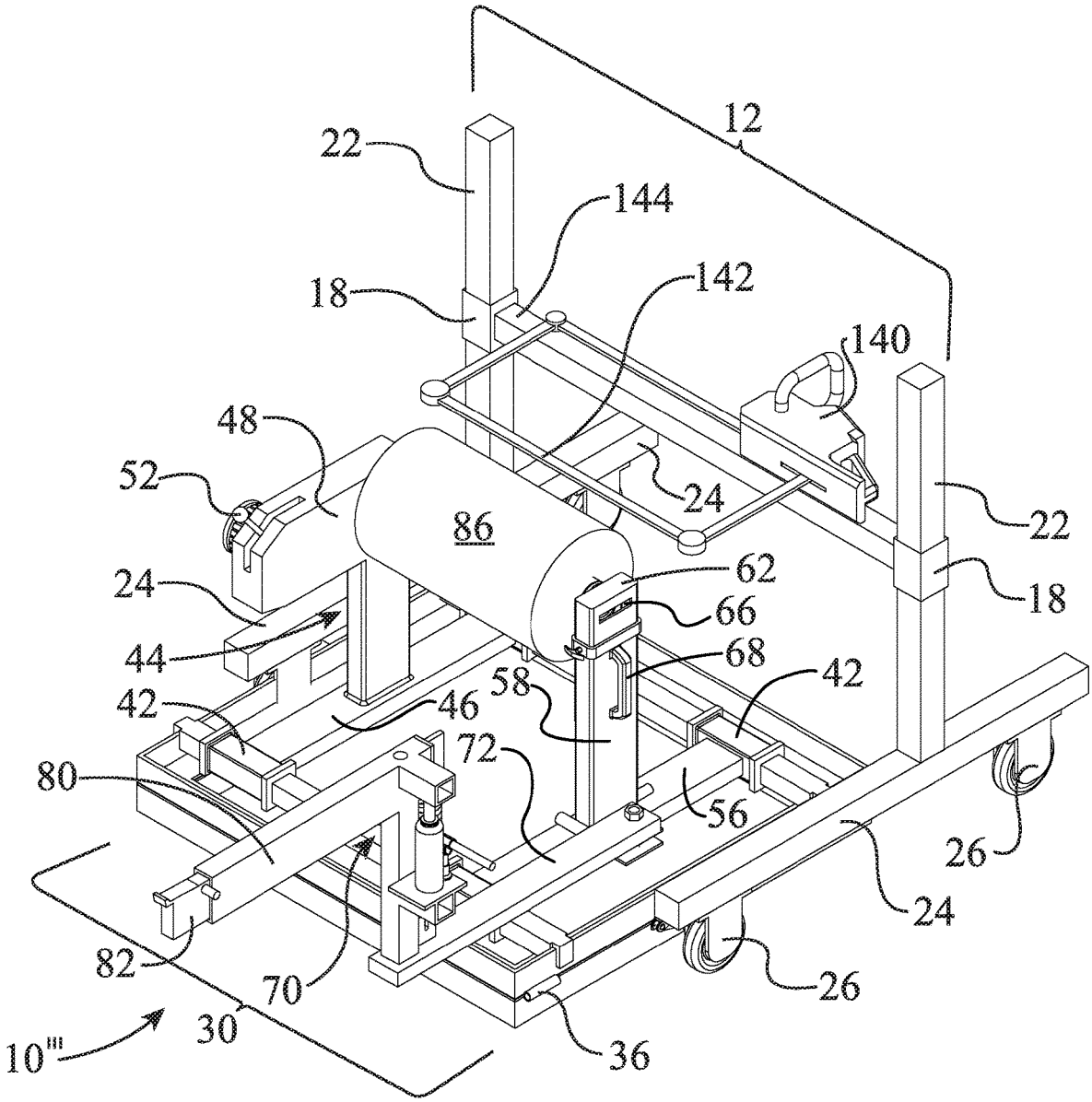
FIG. 27 is a perspective view of a cutting apparatus, according to another embodiment of the invention, wherein the cutting apparatus is provided with a chainsaw-type cutting device.

A fifth exemplary embodiment of the cutting apparatus is seen generally at 10'" in FIG. 27. Referring to this figure, it can be seen that, in many respects, the fifth exemplary embodiment is similar to that of the preceding four embodiments. Moreover, many elements are common to all of the embodiments. For the sake of brevity, the elements that the fifth embodiment of the cutting apparatus 10'" has in common with the preceding embodiments will not be discussed because these components have already been explained in detail above. Furthermore, in the interest of clarity, these elements are denoted using the same reference characters that were used in the preceding four embodiments.

In the fifth exemplary embodiment, as shown in the perspective view of FIG. 27, the cutting device comprises a chain saw 140, rather than the band saw 14 that was described in conjunction with the first three embodiments or the rotary drill 134 that was described in conjunction with the fourth embodiment. The chain saw blade 142 of the chain saw 140 can be used to make a tangential cut into the workpiece 86, similar to that which was described above with regard to the cutting blade 16 of the band saw 14 and the rotary drill bit 136 of the rotary drill 134. After making the initial tangential cut into the workpiece 86, the workpiece 86 is then rotated in order to make a circumferential cut around the periphery of the workpiece 86 (as described above in the preceding embodiments). As depicted in FIG. 27, the chain saw 140 is mounted on a horizontal support bar 144, which is coupled to the upright support post members 22 by means of the mounting collars 18.

Figure 28:
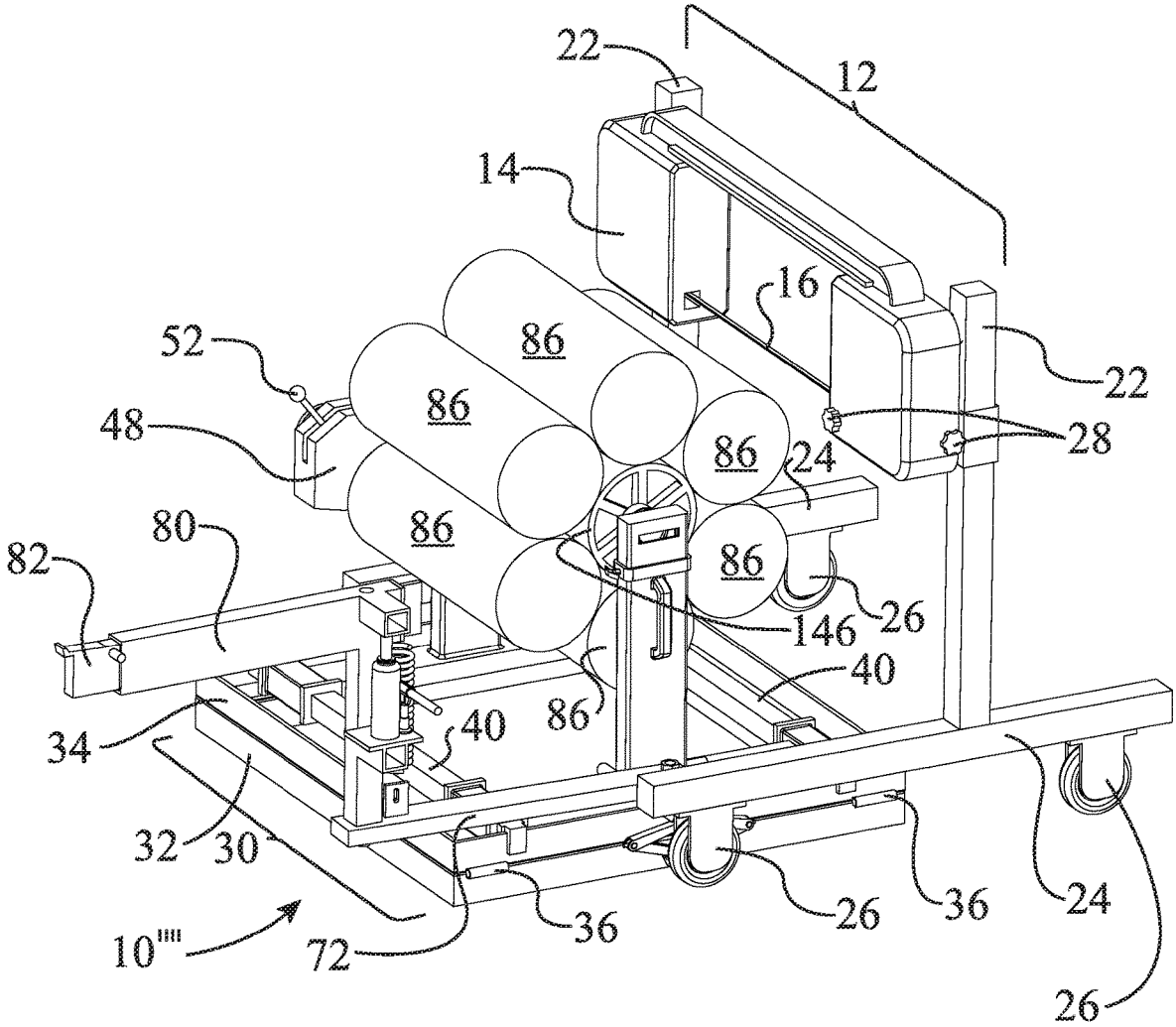
FIG. 28 is a perspective view of a cutting apparatus, according to yet another embodiment of the invention, wherein the workpiece support assembly comprises a cylinder for supporting a plurality of workpieces at one time.

A sixth exemplary embodiment of the cutting apparatus is seen generally at 10"" in FIG. 28. Referring to this figure, it can be seen that, in many respects, the sixth exemplary embodiment is similar to that of the preceding five embodiments. Moreover, many elements are common to all of the embodiments. For the sake of brevity, the elements that the sixth embodiment of the cutting apparatus 10" has in common with the preceding embodiments will not be discussed because these components have already been explained in detail above. Furthermore, in the interest of clarity, these elements are denoted using the same reference characters that were used in the preceding five embodiments.

In the sixth exemplary embodiment, as shown in the perspective view of FIG. 28, the workpiece support assembly 30 of the cutting apparatus 10"" comprises a rotating multiple workpiece cylinder 146 for holding a plurality of workpieces 86 at one time. For example, as shown in FIG. 28, a total of six (6) workpieces 86 (e.g., wooden logs) can be held by the rotating workpiece cylinder 146 so that the plurality of workpieces 86 may be easily cut by the cutting device (e.g., band saw 14) of the cutting apparatus 10". As shown in FIG. 28, the workpiece cylinder 146 is operatively coupled to the headstock and tailstock assemblies 44, 54 of the workpiece support assembly 30.

A seventh exemplary embodiment of the cutting apparatus is seen generally at 200 in FIGS. 29-33. Referring to these figures, it can be seen that, in many respects, the seventh exemplary embodiment is similar to that of the preceding six embodiments. Moreover, many elements are common to all of the embodiments. For the sake of brevity, the elements that the seventh embodiment of the cutting apparatus 200 has in common with the preceding embodiments will not be discussed in detail, if at all, because these components have already been explained in detail above.

Figure 29:
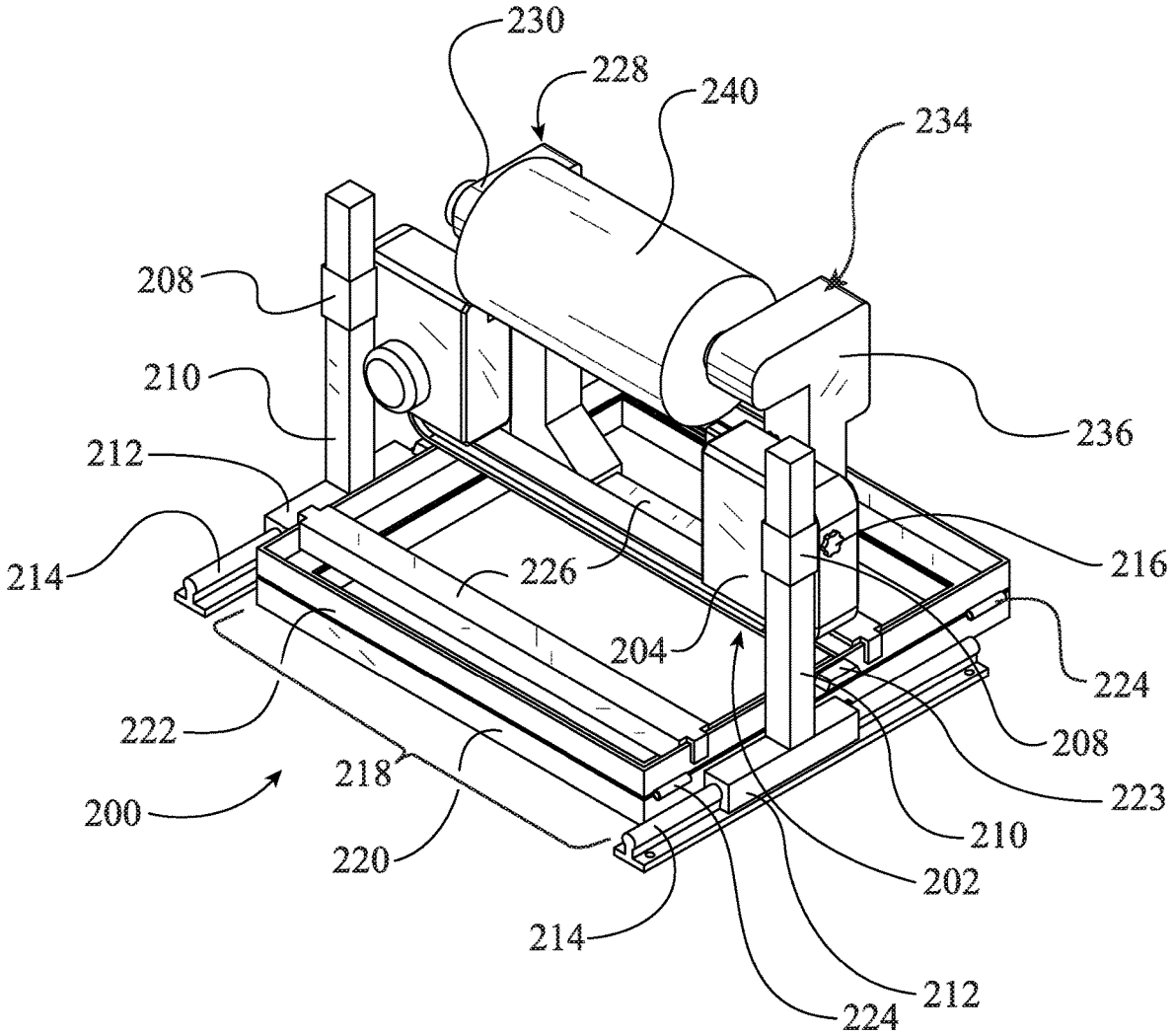
FIG. 29 is a perspective view of a cutting apparatus, according to still another embodiment of the invention, wherein the cutting assembly is disposed in a bottom orientation.
Figure 30:
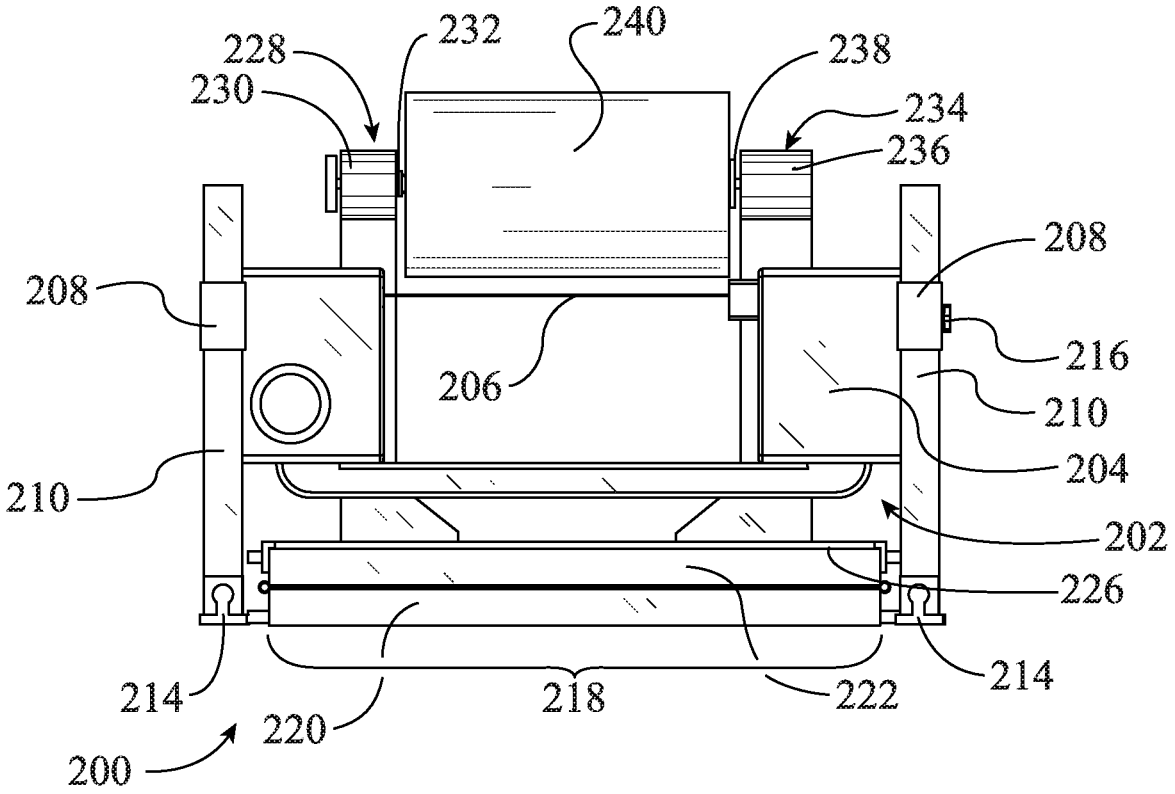
FIG. 30 is a side view of the cutting apparatus of FIG. 29.

In the seventh exemplary embodiment, as shown in the perspective view of FIG. 29, and the side view of FIG. 30, the cutting assembly 202 of the cutting apparatus 200 is disposed in a bottom orientation, which is generally beneath the cylindrical workpiece 240. Advantageously, the bottom orientation of the cutting assembly 202 in FIGS. 29 and 30 can help prevent deleterious binding that may occur between the blade 206 of the cutting assembly 202 and the workpiece 240 in certain cutting situations. In particular, the bottom orientation of the cutting assembly 202 helps to prevent the weight of the workpiece 240 (e.g., a wooden workpiece) from binding the blade 206 of the cutting assembly 202.

With reference again to FIGS. 29 and 30, it can be seen that, similar to the embodiments described above, the base frame of the workpiece support assembly 218 includes a lower base frame section 220 and an upper base frame section 222. The upper base frame section 222 is pivotally coupled to the lower base frame section 220 so as to enable the linearly displaceable cutting blade 206 to cut the workpiece 240 at an angle relative to a rotational axis of the workpiece 240 (e.g., as described above with regard to FIG. 17). As best shown in FIG. 29, the upper base frame section 222 is pivotally coupled to the lower base frame section 220 by means of a plurality of hinge members 224. In the illustrated embodiment, a pair of hinge members 224 are disposed on each of two opposite sides of the upper and lower base frame sections 220, 222. Each pair of hinge members 224 comprises spaced apart hinge members 224, which are each disposed near a respective corner of the upper and lower base frame sections 220, 222. Each of the hinge members 224 may be in the form of a barrel hinge with a removable pin member. Also, as shown in the illustrated embodiment of FIGS. 29 and 33, the upper and lower base frame sections 220, 222 may each be provided with a scissor jack engagement member 223 on each of the opposite sides thereof in order to accommodate a scissor jack assembly (as described above with regard to FIGS. 1, 2, and 16-19) for elevating a side of the upper base frame section 222 above a respective side of the lower base frame section 220, thereby forming a gap between the side of the upper base frame section 222 and the side of the lower base frame section 220.

Referring again to FIG. 29, it can be seen that a plurality of spaced-apart horizontal support members 226 (e.g., two (2) horizontal support members 226) are disposed on the top of the upper base frame section 222. One of the illustrated horizontal support members 226 supports the headstock assembly 228 and the tailstock assembly 234 of the workpiece support assembly 218. In particular, the base of the L-shaped vertical member 230 of the headstock assembly 228 is attached proximate to a first end of the horizontal support member 226, while the base of the L-shaped vertical member 236 of the tailstock assembly 234 is attached to a second end of the horizontal support member 226, the second end being disposed generally opposite to the first end of the horizontal support member 226. It is to be understood that the workpiece support assembly 218 can be selectively positioned on either of the horizontal support members 226 to offer cutting flexibility. Advantageously, the L-shaped geometry of the headstock and tailstock vertical members 230, 236 enables the cutting assembly 202 to be disposed closer to the rotational axis of the cylindrical workpiece 240, thereby permitting a deeper cut into the workpiece 240 and more layers to be removed from the workpiece 240. As best shown in the side view of FIG. 30, the headstock assembly 228 further comprises a workpiece mounting means 232 (e.g., a pointed mounting bracket) for securing one longitudinal end of the cylindrical workpiece 240, while the tailstock assembly 234 further comprises a workpiece mounting means 238 (e.g., a pointed mounting bracket) for securing the opposite longitudinal end of the cylindrical workpiece 240.

Next, with reference again to FIGS. 29 and 30, the cutting assembly 202 of the cutting apparatus 200 will be described in detail. As shown in these figures, the cutting assembly 202 of the illustrated embodiment comprises a band saw 204 with a cutting blade 206 that is displaced in a generally linear manner (e.g., by rotating the cutting blade 206 within the housing of the band saw 204). The band saw 204 is provided with one or more adjustment knobs 216 disposed thereon for adjusting the height of the band saw 204 on the upright support post members 210. It can be seen that the cutting assembly 202 additionally comprises a support frame with opposed, generally horizontal base frame members 212 that are respectively attached to opposed, generally upright support post members 210. In the illustrated embodiment, each of the opposed base frame members 212 comprises an elongated groove formed therein for slidingly engaging respective base rail members 214, which may be bolted to the ground or floor. As such, the cutting assembly 202 is capable of being slidingly displaced on the base rail members 214 relative to the workpiece support assembly 218 so that a desired horizontal position of the band saw 204 may be obtained. After the band saw 204 is adjusted to its desired horizontal position, it may be locked in place relative to the base rail members 214. Advantageously, the mounting of the cutting assembly 202 on base rail members 214, rather than the wheel assemblies 26 described above, offers a more controlled horizontal displacement of the cutting assembly 202 and reduces the likelihood that the cutting blade 206 of the band saw 204 will inadvertently shift during the cutting of the workpiece 240 (i.e., after the cutting assembly 202 is locked in place on the rail members 214). Turning again to FIGS. 29 and 30, it can be seen that the band saw 204 is adjustably supported on opposed upright support post members 210 by means of adjustable mounting collars 208. When the knob(s) 216 disposed on one or more lateral sides of the band saw 204 are loosened, the mounting collars 208 are capable of sliding in a generally vertical direction relative to the upright support post members 210 so that the height of the band saw 204 can be adjusted relative to the ground. The height of the band saw 204 relative to the ground determines the cut diameter on the cylindrical workpiece 240. In the arrangement of FIGS. 29 and 30, the workpiece support assembly 218 rotates the cylindrical workpiece 240 in a counter-clockwise direction as it is tangentially cut by the cutting blade 206 of the band saw 204.

In other embodiments, rather than using dual base rail members 214, it is to be understood that the cutting assembly 202 of the cutting apparatus 200 may be supported on a single base rail member (e.g., as part of a monorail-type cutting apparatus). In these other embodiments, the cutting head of the cutting apparatus may be mounted in cantilevered-type manner from the single base rail member.

Figure 31:
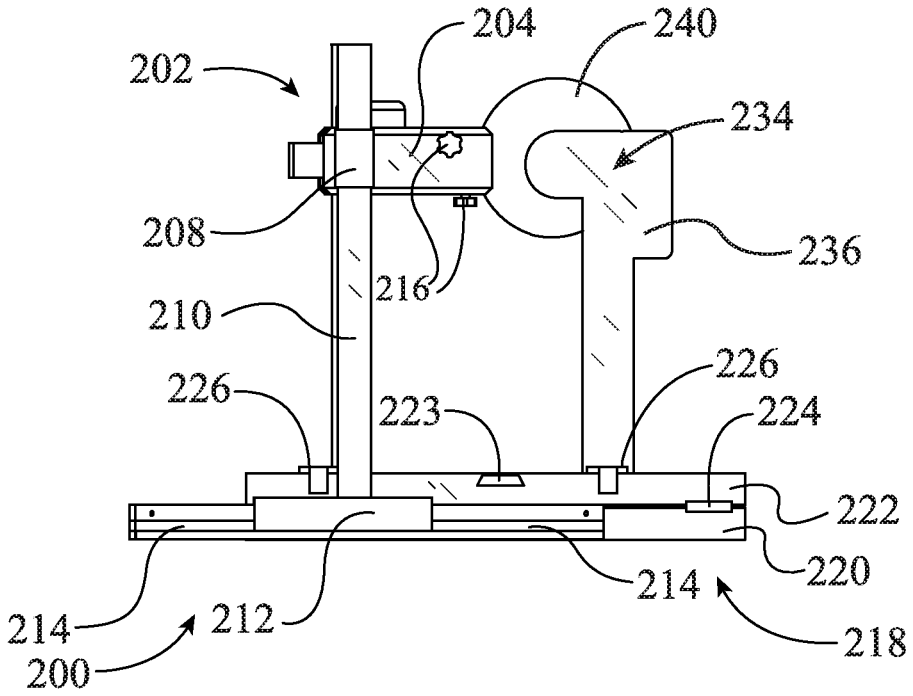
FIG. 31 is an end view of the cutting apparatus of FIG. 29, wherein the cutting assembly is disposed in a side orientation rather than a bottom orientation.
Figure 32:
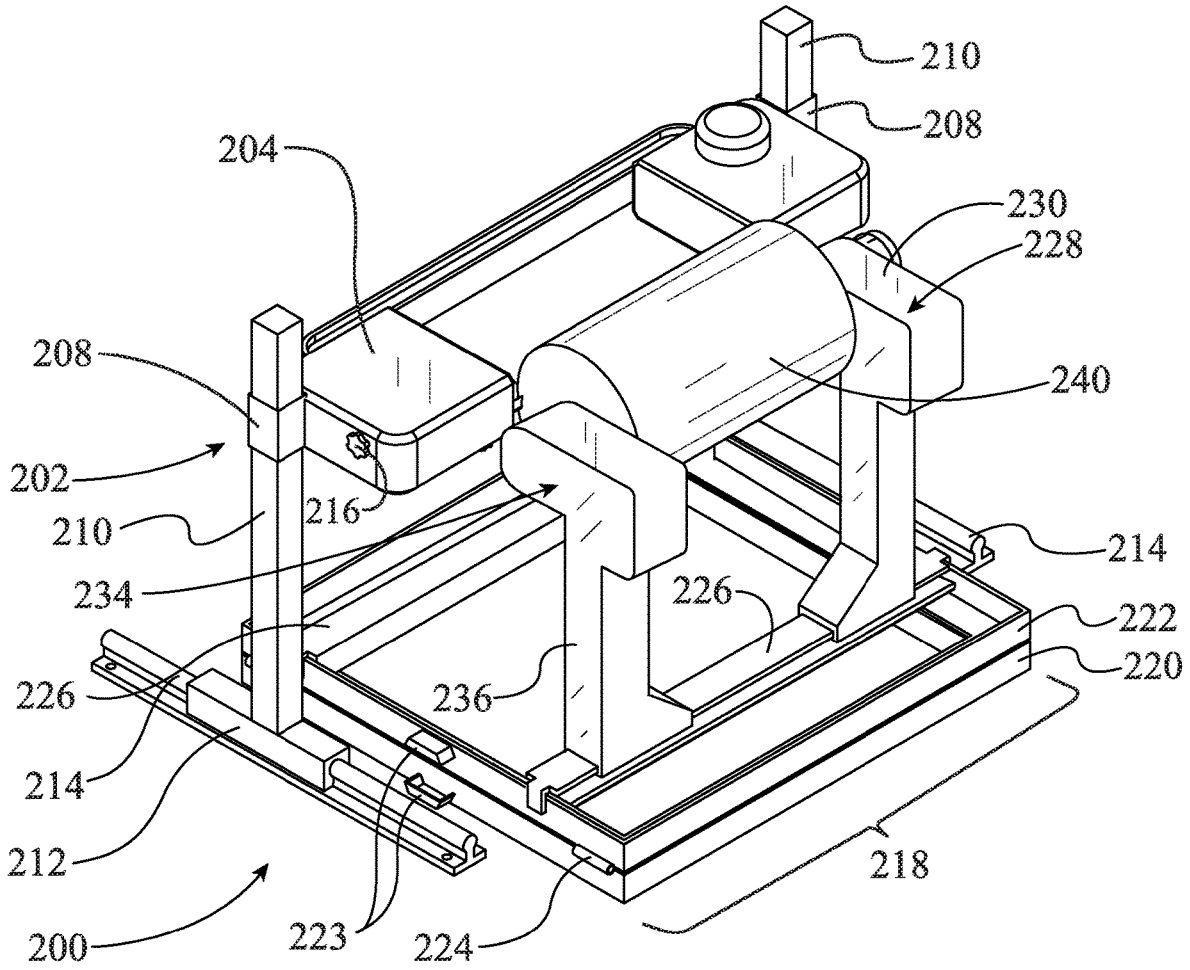
FIG. 32 is an end-front perspective view of the cutting apparatus of FIG. 31.
Figure 33:
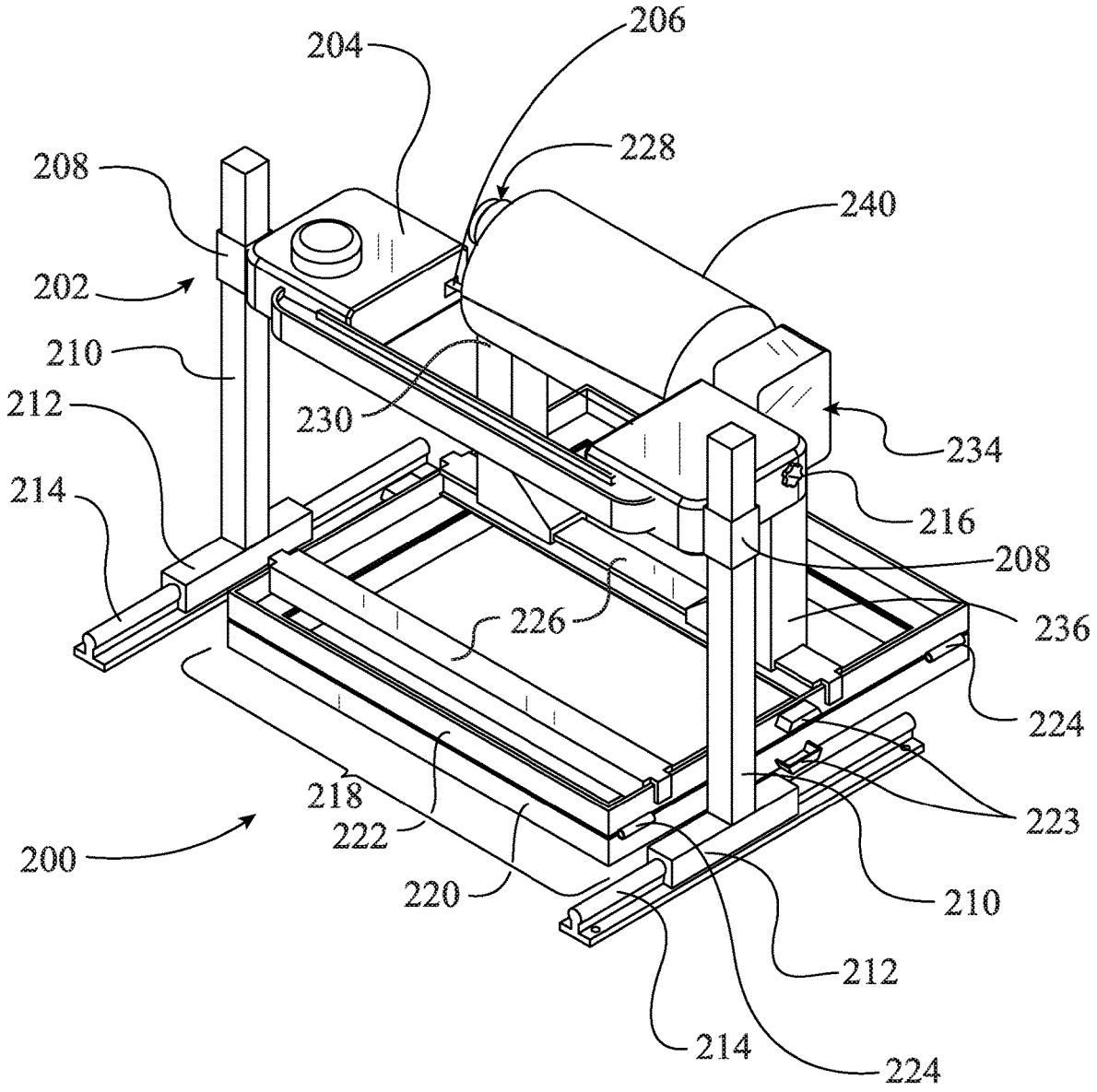
FIG. 33 is a rear-end perspective view of the cutting apparatus of FIG. 31.

An alternative cutting configuration of the cutting apparatus 200 is illustrated in FIGS. 31-33. As shown in these figures, the cutting assembly 202 of the cutting apparatus 200 is disposed in a side orientation, wherein the band saw 204 has been rotated ninety (90) degrees relative to its illustrated position in FIGS. 29 and 30. The different cutting orientations depicted in FIGS. 29-30 and 31-33 illustrate that the cylindrical workpiece 240 is capable of being cut in both a "bottom-up" manner (FIGS. 29-30) and a "top-down" manner (FIGS. 31-33).

An eighth exemplary embodiment of the cutting apparatus is seen generally at 200' in FIGS. 34-37. Referring to these figures, it can be seen that, in some respects, the eighth exemplary embodiment is similar to that of the preceding seventh embodiment. Moreover, many elements are common to all of the embodiments. For the sake of brevity, the elements that the eighth embodiment of the cutting apparatus 200' has in common with the seventh embodiment 200 will not be discussed in detail, if at all, because these components have already been explained in detail above.

In the eighth exemplary embodiment, as shown in FIGS. 34-37, the cutting assembly 202 and the cylindrical workpiece 240' that is being cut are both disposed in a vertical orientation, rather than a horizontal orientation that was illustrated in the preceding embodiments. Advantageously, orienting the workpiece 240' in a vertical orientation, rather than in a horizontal orientation, enables much larger and heavier workpieces (e.g., wooden logs) to be accommodated by the cutting apparatus 200' by preventing the cracking of the cut portion of the workpiece as a result of the workpiece weight being exerted thereon.

With reference again to FIGS. 34-37, it can be seen that the workpiece support assembly generally includes a base plate member 242, a headstock assembly 228', and a tailstock assembly 234'. The headstock assembly 228' generally comprises a pair of upper vertical support members 230' and a pair of lower vertical support members 231. In order to accommodate workpieces having different heights, each upper vertical support member 230' of the headstock assembly 228' is slidingly adjustable relative to its respective lower vertical support member 231 in a telescopic manner (see e.g., FIG. 35). As shown in these figures, a top plate member 260 is mounted to the upper ends of the upper vertical support members 230' in a cantilevered manner. As a result of the telescoping upper vertical support members 230', the height of the top plate member 260 relative to the top surface of the base plate member 242 is capable of being selectively adjusted by a user of the cutting apparatus 200' by sliding the vertically extending upper support members 230' into, and out of, the interior cavities of their respective lower vertical support members 231. As best shown in the side view of FIG. 35, the headstock assembly 228' further comprises a rotational workpiece mounting means 232' (e.g., a pointed mounting bracket) for securing the upper longitudinal end of the cylindrical workpiece 240'. The workpiece mounting means 232' is attached to the underside of the top plate member 260 of the headstock assembly 228' by the headstock attachment member 248 (e.g., see FIG. 35). As shown in the perspective views of FIGS. 34, 36, and 37, the top plate member 260 is provided with a handle crank 233 on the top thereof in order to enable a user to engage the workpiece mounting means 232' of the headstock assembly 228' into the top end of the workpiece 240' (i.e., the handle crank 233 allows the pointed workpiece mounting means 232' to be tightened into the top end of the workpiece 240'). The lower longitudinal end of the cylindrical workpiece 240' is supported by, and sits upon the tailstock assembly 234' with rotating workpiece mounting means 238' (see FIG. 37). The tailstock assembly 234' may include actuating means in the form of an electric motor 274 with a drive shaft 276 (see FIG. 38) for automatically rotating the cylindrical workpiece 240' relative to the stationary portions of the headstock assembly 228' and the tailstock assembly 234' of the cutting apparatus 200'. Alternatively, as shown in FIG. 39, another version of the tailstock assembly 234" may include manual rotational means in the form of a hand crank 284 for manually rotating the cylindrical workpiece 240' relative to the stationary portions of the headstock assembly 228' and the tailstock assembly 234' of the cutting apparatus 200'''.

Figure 34:
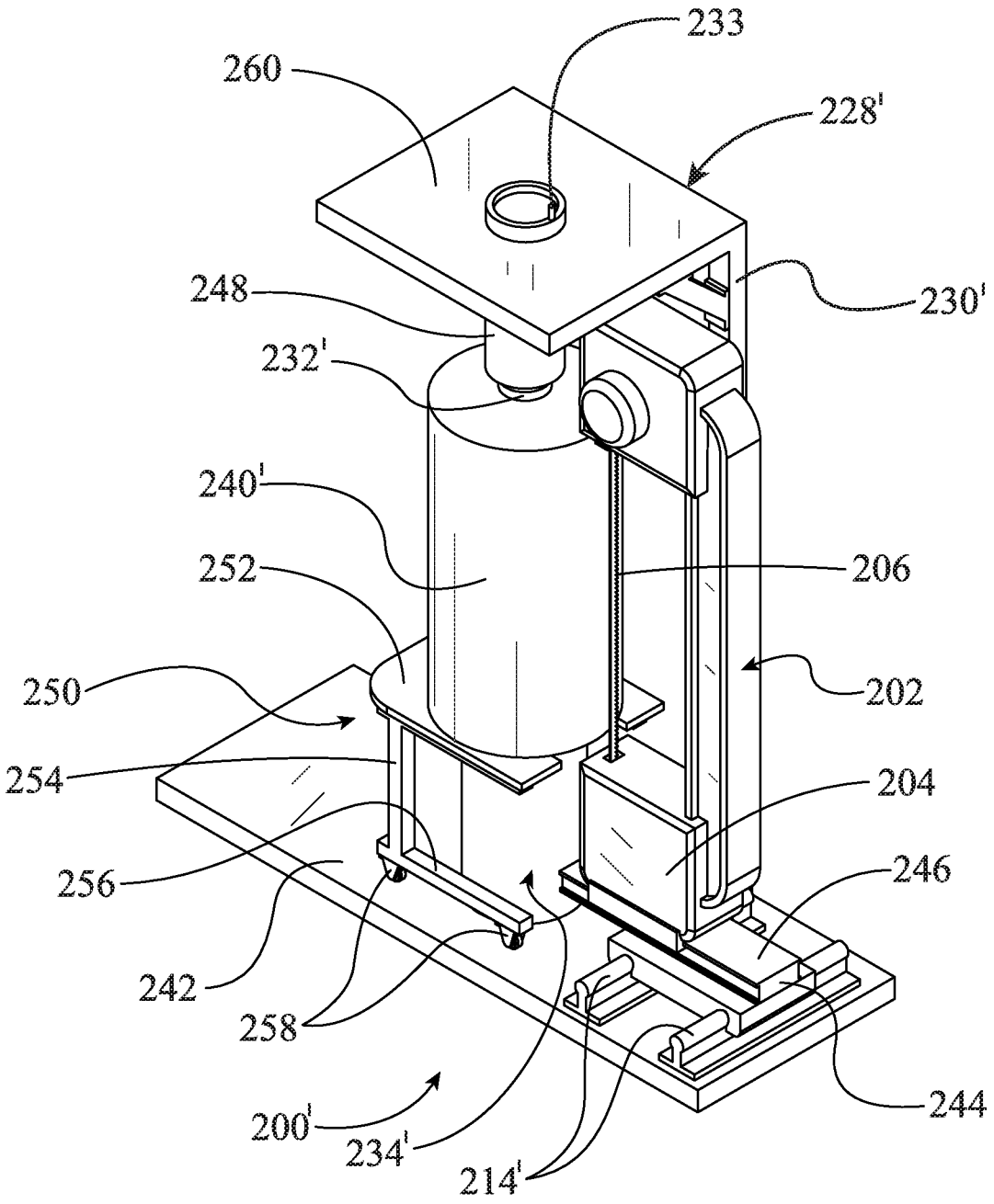
FIG. 34 is a perspective view of a cutting apparatus, according to yet another embodiment of the invention, wherein the cutting assembly and the workpiece are both disposed in a vertical orientation.
Figure 35:
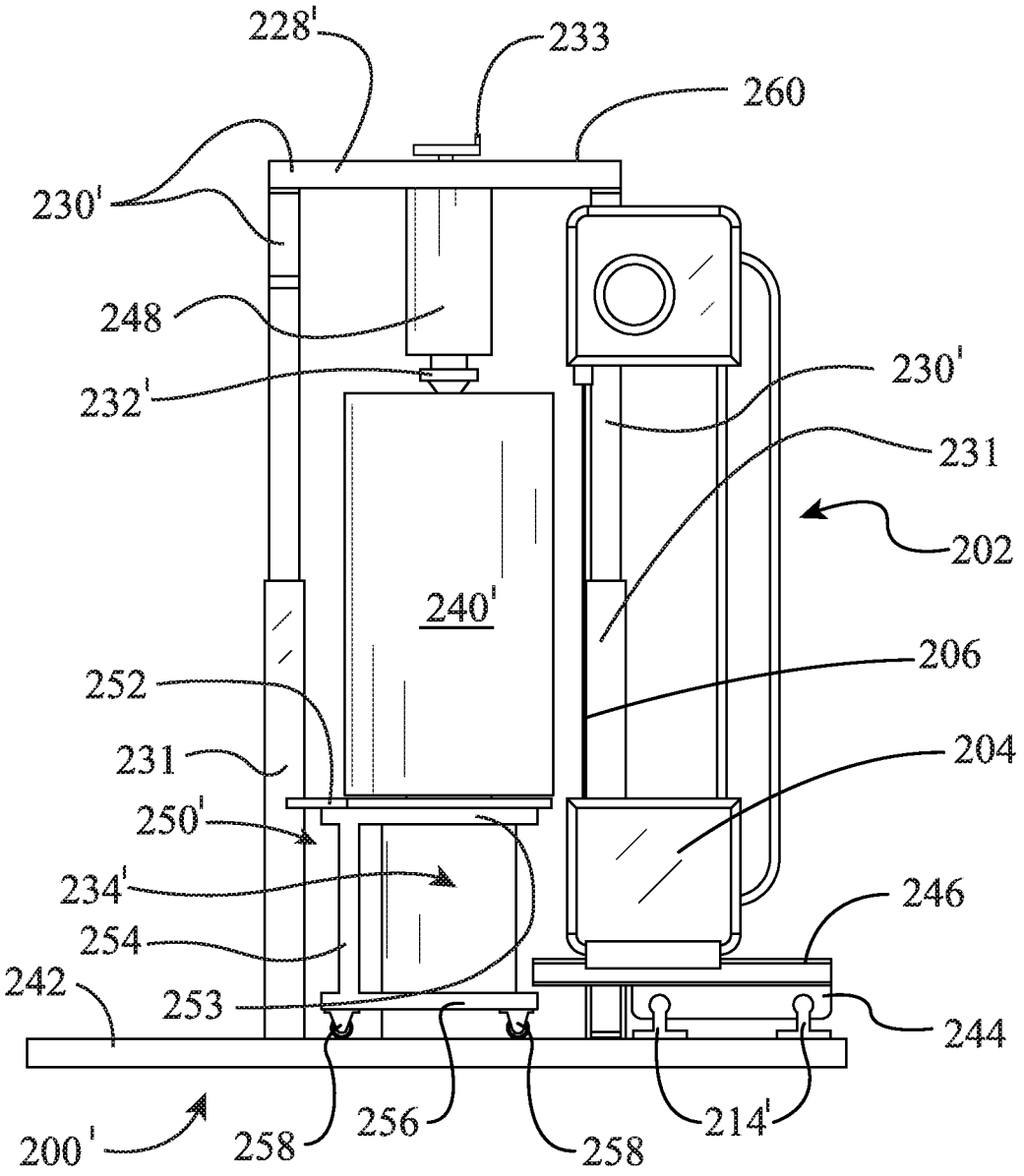
FIG. 35 is a side view of the cutting apparatus of FIG. 34.
Figure 36:
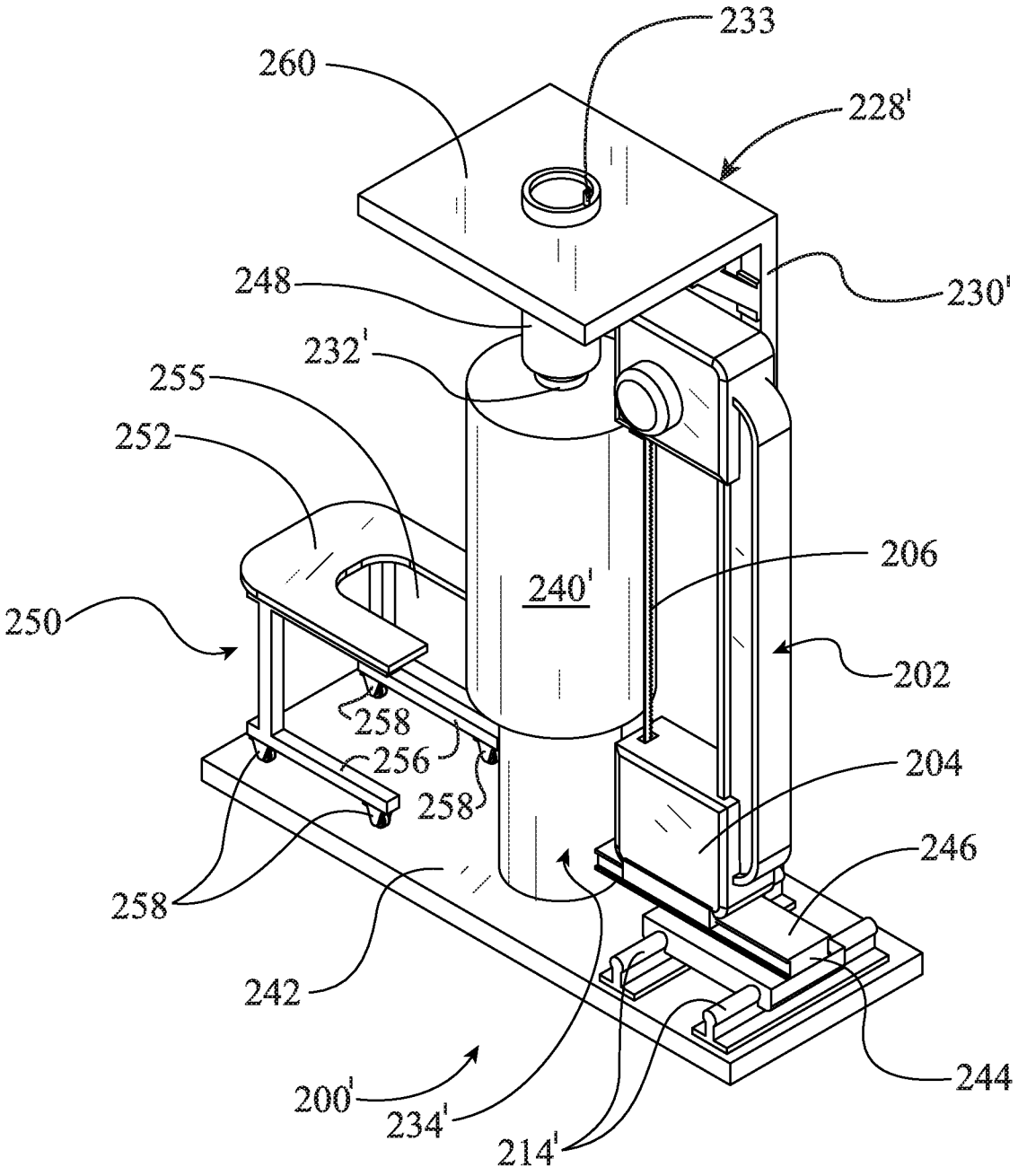
FIG. 36 is another perspective view of the cutting apparatus of FIG. 34, wherein a movable workpiece table is shown displaced from the workpiece support assembly and the workpiece supported thereon.

Next, with reference again to FIGS. 34-37, the cutting assembly 202 of the cutting apparatus 200' will be described in detail. As shown in these figures, the cutting assembly 202 of the illustrated embodiment comprises a vertically-oriented band saw 204 with a cutting blade 206 that is displaced in a generally linear manner (e.g., by rotating the cutting blade 206 within the housing of the band saw 204). It can be seen that the cutting assembly 202 additionally comprises an adjustable support base assembly that includes a pair of spaced-apart rail members 214', which are fixed to base plate 242, and a translatable base member 244. As shown in FIGS. 34-37, the bottom surface of the translatable base member 244 is provided with grooves formed therein that correspond to each of the rail members 214' so that the translatable base member 244 is slidable on the rail members 214'. Also, as illustrated in FIGS. 34 and 36, the translatable base member 244 comprises a centrally-disposed top projection 246 that is slidingly received within a groove disposed in the bottom surface of the band saw 204 so that the band saw 204 is capable of being displaced relative to the base member 244. As such, by virtue of the sliding engagement between the translatable base member 244 and the pair of spaced-apart rail members 214', the band saw 204 is capable of being horizontally adjusted in a width direction (i.e., in a short dimension) of the base plate member 242. Similarly, by virtue of the sliding engagement between the bottom portion of the band saw 204 and the translatable base member 244, the band saw 204 is capable of being horizontally adjusted in a lengthwise direction (i.e., in a long dimension) of the base plate member 242, which is disposed approximately ninety (90) degrees relative to the width direction of the base plate member 242. In order words, the band saw 204 is generally adjustable in x and y directions of the base plate member 242.

Next, referring again to FIGS. 34-37, the displaceable support table 250 of the cutting apparatus 200' will be described. As shown in these figures, the displaceable support table 250 comprises a tabletop 252 supported on a plurality of horizontally-disposed tabletop frame members 253 (see FIG. 35). The horizontally-disposed tabletop frame members 253 of the table 250 are mounted to a pair of laterally spaced-apart horizontal base members 256 by a pair of laterally spaced-apart vertical support members 254. Also, in the illustrated embodiment, each of the laterally spaced-apart horizontal base members 256 of the table 250 includes a pair of wheel or caster assemblies 258 for enabling the heavy workpiece 240' to be transported using the table 250. As shown in FIGS. 34-37, the wheel or caster assemblies 258 in each pair are disposed on generally opposite ends of the horizontal base members 256 of the table 250. In addition, as best illustrated in FIG. 36, the tabletop 252 of the table 250 comprises a cutout or a notch 255 disposed therein so as to accommodate the tailstock assembly 234' of the workpiece support assembly (i.e., a portion of the tailstock assembly 234' is received within the cutout or notch 255 of the tabletop 250). Advantageously, the displaceable support table 250 is designed to support the weight of the heavy workpiece 240' so that the workpiece 240' can be easily transported by a user after it has been cut by the cutting apparatus 200'. In one or more embodiments, the table 250 may be height-adjustable so as to allow it to be raised and lowered underneath the lower end of the workpiece 240' (e.g., the spaced-apart vertical support members 254 may be telescopic).

Figure 37:
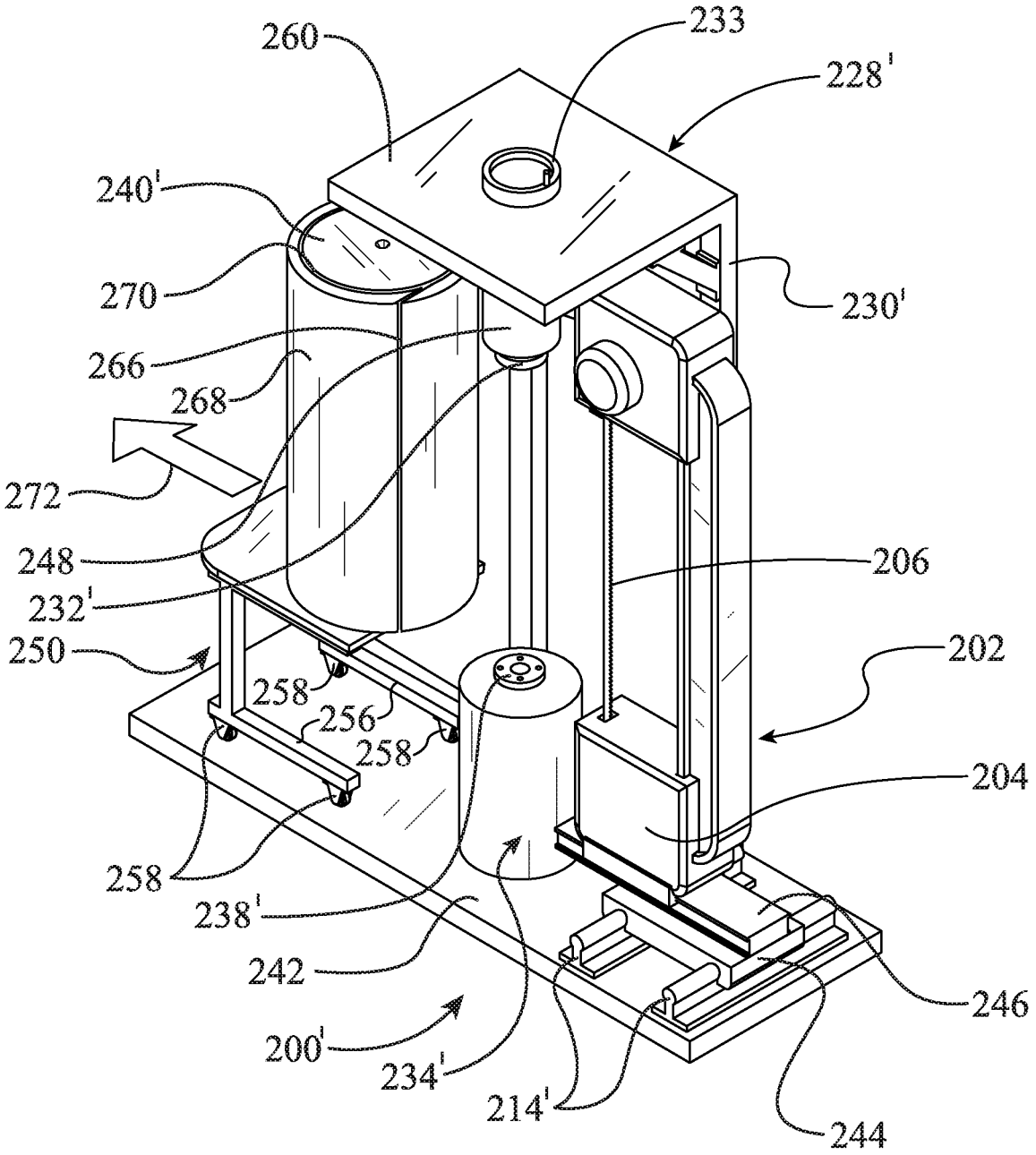
FIG. 37 is yet another perspective view of the cutting apparatus of FIG. 34, wherein a cylindrical workpiece is shown being unloaded from the cutting apparatus after it has been cut.

In FIG. 37, the manner in which the cylindrical workpiece 240' is unloaded from the cutting apparatus 200' is illustrated. After the tangential cut 266 and the circumferential cut 270 have been made in the workpiece 240' so as to form the annular cut portion 268 of the workpiece 240', the cut workpiece 240' is removed from the workpiece support assembly of the cutting apparatus 200' (e.g., in the direction of arrow 272 in FIG. 37), and it is placed onto the displaceable support table 250. As described above, the support table 250 with casters 258 disposed thereunder allows the heavy workpiece 240' to be easily transported to another desired location.

Figure 38:
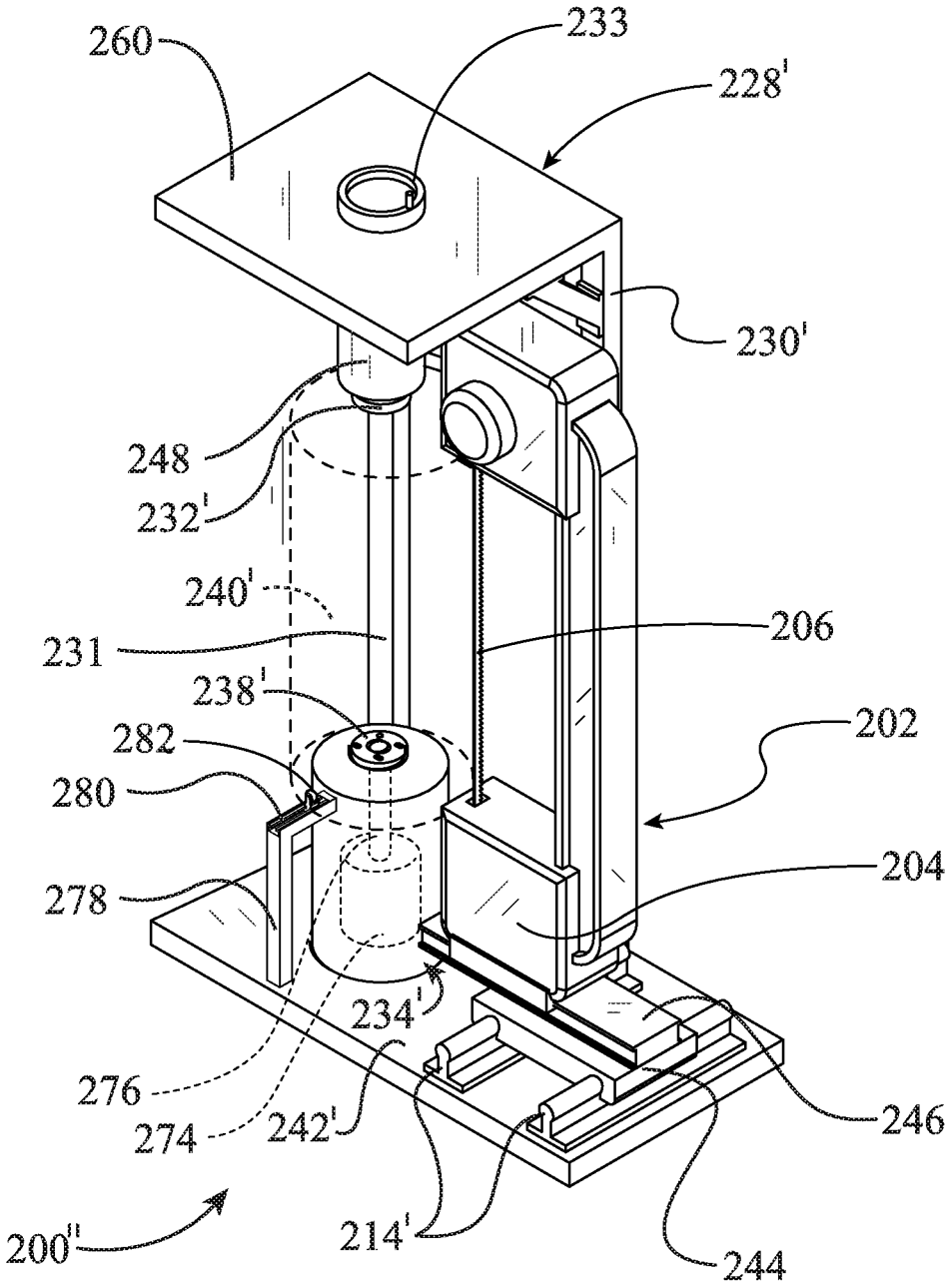
FIG. 38 is a perspective view of a cutting apparatus, according to still another embodiment of the invention, wherein the tailstock assembly of the cutting apparatus is provided with an L-shaped workpiece support arm.
Figure 39:
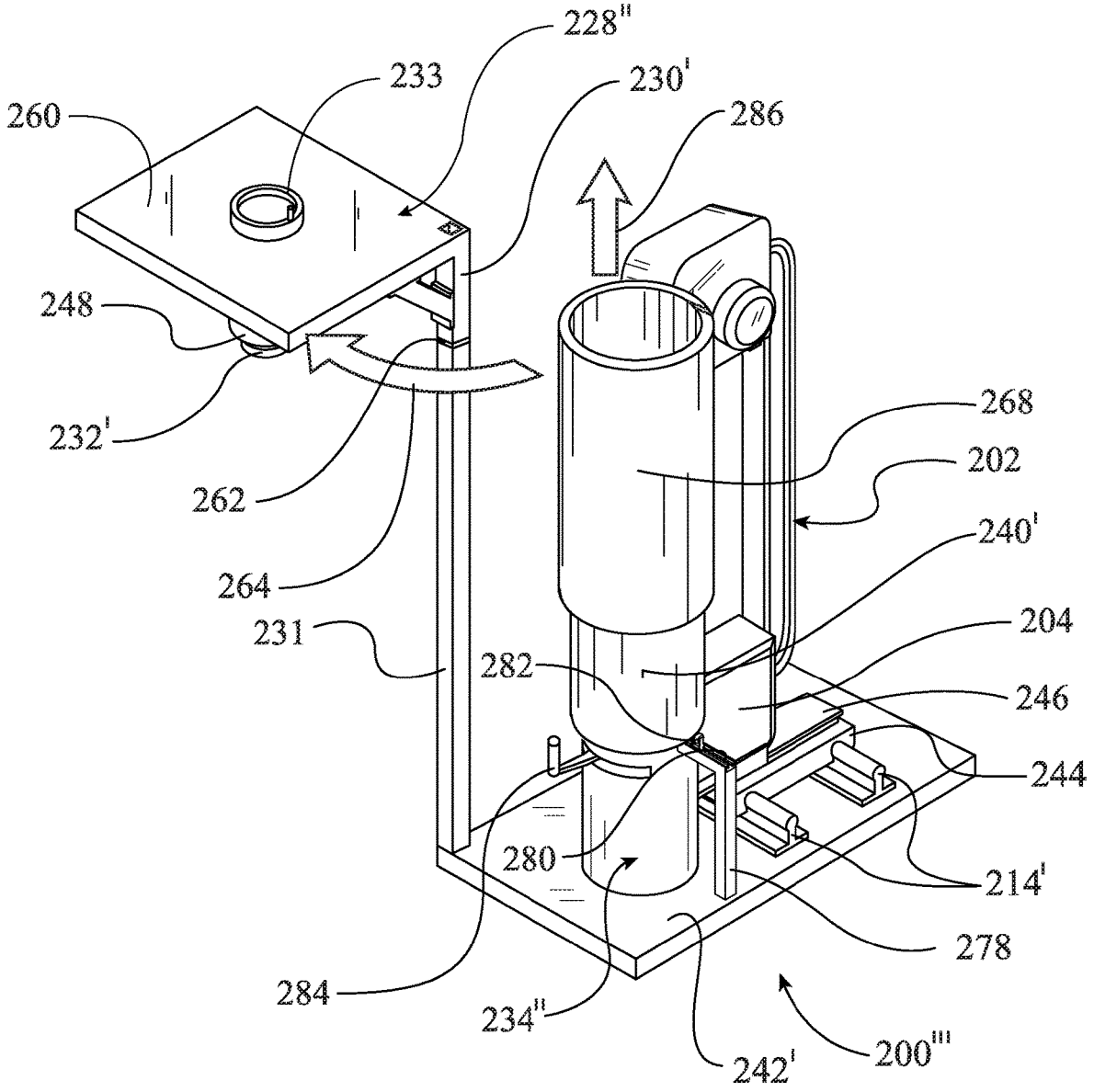
FIG. 39 is a perspective view of a cutting apparatus, according to yet another embodiment of the invention, wherein the headstock assembly of the cutting apparatus is provided with a swiveling top portion.

A ninth exemplary embodiment of the cutting apparatus is seen generally at 200" in FIG. 38. Referring to this figure, it can be seen that, in many respects, the ninth exemplary embodiment is similar to that of the preceding eighth embodiment. Moreover, many elements are common to all of the embodiments. For the sake of brevity, the elements that the ninth embodiment of the cutting apparatus 200" has in common with the eighth embodiment 200' will not be discussed because these components have already been explained in detail above.

In the ninth exemplary embodiment, as shown in FIG. 38, the tailstock assembly 234' of the cutting apparatus 200" is provided with an L-shaped workpiece support arm 278 attached thereto for supporting a cut portion of the cylindrical workpiece 240'. In particular, it can be seen in FIG. 38 that the base end of the L-shaped workpiece support arm 278 is affixed to the top surface of the base plate 242', while the end of the upper horizontal member of the L-shaped workpiece support arm 278 is affixed to the side of the tailstock assembly 234'. Also, referring again to FIG. 38, it can be seen that the top surface of the upper horizontal member of the L-shaped workpiece support arm 278 is provided with an elongate groove 280 formed therein for accommodating a wheel assembly or caster 282 that is slidingly engaged with the groove 280. As a result of the sliding engagement between the wheel assembly or caster 282 and the elongate groove 280, the wheel assembly 282 is capable of being selectively positioned along the length of the groove 280 so that cylindrical workpieces 240' of various outer diameters may be readily accommodated. For cylindrical workpieces 240' having smaller outer diameters, the wheel assembly 282 is moved close to the side of the tailstock assembly 234' to support the cut portion of the workpiece 240'. Conversely, for cylindrical workpieces 240' having larger outer diameters, the wheel assembly 282 is moved close to the right angle of the L-shaped workpiece support arm 278 to support the cut portion of the workpiece 240'.

A tenth exemplary embodiment of the cutting apparatus is seen generally at 200''' in FIG. 39. Referring to this figure, it can be seen that, in many respects, the tenth exemplary embodiment is similar to that of the preceding eighth and ninth embodiments. Moreover, many elements are common to all of the embodiments. For the sake of brevity, the elements that the tenth embodiment of the cutting apparatus 200''' has in common with the eighth and ninth embodiments 200' and 200" will not be discussed because these components have already been explained in detail above.

In the tenth exemplary embodiment, as shown in FIG. 39, the headstock assembly 228" is provided with a swivel mechanism 262 that enables the top portion of the headstock assembly 228" to swivel or rotate relative to the lower portion of the headstock assembly 228" (e.g., in a clockwise direction as diagrammatically indicated by the arrow 264 in FIG. 39). More particularly, as shown in FIG. 39, the top plate member 260 and the upper portion of the upper vertical support member 230' swivels relative to the lower portion of the upper vertical support member 230' and the lower vertical support member 231. Advantageously, the swiveling top portion of the headstock assembly 228" enables the top removal of the annular cut portion 268 from the remainder of the workpiece 240' (i.e., as diagrammatically illustrated by the arrow 286 in FIG. 39, the annular cut portion 268 can be removed from the top of the cutting apparatus 200'''). Also, as described above, the cutting apparatus 200''' also includes an alternative tailstock assembly 234" with a hand crank 284 provided therein for manually rotating the workpiece 240' during the cutting thereof.

Figure 40:
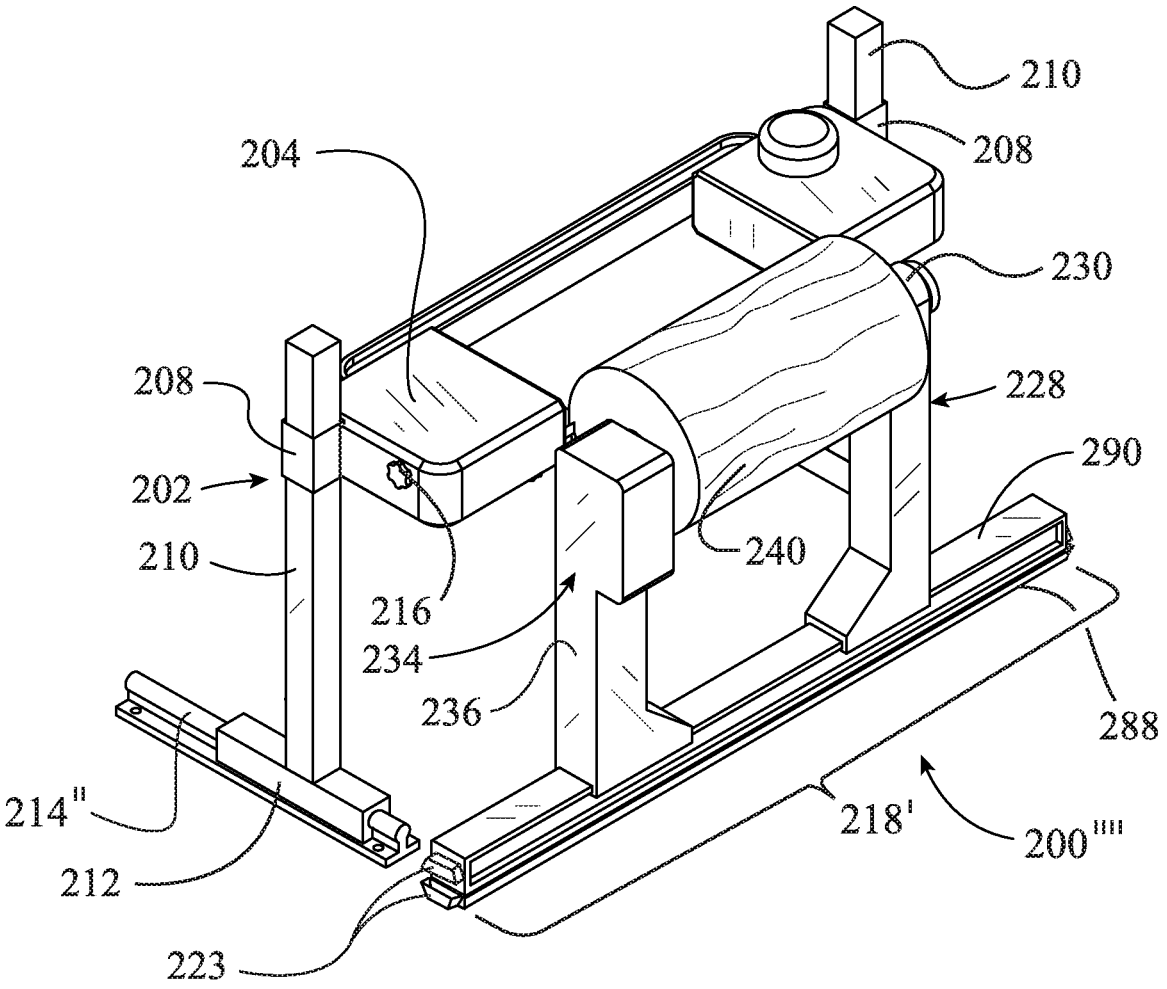
FIG. 40 is a perspective view of a cutting apparatus, according to still another embodiment of the invention, wherein the workpiece support assembly utilizes beam-like support members underneath the headstock and tailstock assemblies.

An eleventh exemplary embodiment of the cutting apparatus is seen generally at 200'''' in FIG. 40. Referring to this figure, it can be seen that, in many respects, the eleventh exemplary embodiment is similar to that of the seventh embodiment described above. Moreover, many elements are common to both such embodiments. For the sake of brevity, the elements that the eleventh embodiment of the cutting apparatus 200" has in common with the seventh embodiment 200 will not be discussed because these components have already been explained in detail above.

In the eleventh exemplary embodiment, as shown in FIG. 40, the headstock and tailstock assemblies 228, 234 of the workpiece support assembly 218' are supported on a beam-like lower base support member 288 and a beam-like upper base support member 290, rather than the lower base frame section 220 and the upper base frame section 222 described above in conjunction with the seventh embodiment. In one or more installations, the lower base support member 288 of the cutting apparatus 200'''' in FIG. 40 may be affixed to the floor or ground using suitable fastener members (e.g., bolts) so that the workpiece 240 is securely held in place during the cutting thereof. Similar to that described above for the seventh embodiment, the upper base support member 290 may be pivotally coupled to the lower base support member 288 so as to enable the linearly displaceable cutting blade 206 to cut the workpiece 240 at an angle relative to a rotational axis of the workpiece 240 (e.g., as described above with regard to FIG. 17). As described above, the upper base support member 290 may be pivotally coupled to lower base support member 288 by means of a plurality of hinge members. For example, a hinge member may be disposed on each of two opposite sides of the upper and lower base support members 288, 290. Each of the hinge members may be in the form of a barrel hinge with a removable pin member. Also, as shown in the illustrated embodiment of FIG. 40, the upper and lower base support members 288, 290 may each be provided with a scissor jack engagement member 223 on each of the opposite ends thereof in order to accommodate a scissor jack assembly (as described above with regard to FIGS. 1, 2, and 16-19) for elevating a side of the upper base support member 290 above a respective side of the lower base support member 288, thereby forming a gap between the side of the upper base support member 290 and the side of the lower base support member 288. Advantageously, the embodiment of FIG. 40 offers a more compact arrangement of the cutting apparatus 200" with a smaller overall footprint. As shown in FIG. 40, the rail members 214" on which the cutting assembly 202 is slidingly disposed are shorter than the rail members 214 of the seventh embodiment because they are not required to span the generally square base frame sections 220, 222.

In one or more embodiments, the cutting apparatuses 10, 10', 10", 10''', 10'''', 200, 200', 200", 200''', and 200" described above are used to practice a method for forming cylindrical, conical, and/or annular stock materials. The method generally comprises the steps of: (i) providing a cutting apparatus 10, which includes: a workpiece support assembly 30, the workpiece support assembly 30 configured to hold a workpiece 86 in position by means of one or more rotational attachment points, the workpiece support assembly 30 allowing generally single degree of freedom rotation while the workpiece is being cut, and the workpiece support assembly 30 generally fixing the workpiece 86 in the other directions of movement during the cutting thereof; and a cutting assembly 12 having a cutting blade, the cutting blade configured to engage the workpiece 86, and circumferentially cut a portion of material from the workpiece 86; (ii) holding, by using the workpiece support assembly 30, the workpiece 86 in a generally stationary position relative to the cutting blade; (iii) displacing the cutting blade towards the workpiece 86 until the cutting blade engages the workpiece 86 at a predetermined location (e.g., at a location that is generally vertically aligned with the rotational axis of the workpiece 86); and (iv) rotating the workpiece 86, by using the workpiece support assembly 30, so that a portion of material (e.g., annular cut portion 87) is circumferentially cut from the workpiece 86.

In one further embodiment of the method, the cutting blade comprises a linearly displaceable cutting blade 16 (e.g., on a bandsaw 14); and the step of displacing the cutting blade 16 towards the workpiece 86 further comprises displacing the linearly displaceable cutting blade 16 tangentially into the workpiece 86 until the linearly displaceable cutting blade 16 reaches the predetermined location in the workpiece 86. In other further embodiments, the cutting blade 16 of the bandsaw 14, or the chain saw blade 142 of the chain saw 140, is initially detached from the rest of the saw 14 or 140, then inserted through a bored hole, and finally fastened back together (e.g., by welding) with the saw 14 or 140 to make the circumferential cut. In still other further embodiments, a bucksaw or bow saw is used to make the cut into the workpiece 86 by utilizing a reciprocal-type cutting action.

In an alternative further embodiment of the method, the cutting blade comprises a rotary cutting blade; and the method further comprises the step of boring or drilling a hole into the workpiece 86 at the predetermined location. Also, in this further embodiment, the step of displacing the cutting blade towards the workpiece 86 further comprises inserting the rotary cutting blade into the bored or drilled hole of the workpiece 86 at the predetermined location, and the step of rotating the workpiece 86 comprises making a circumferential cut into the workpiece 86 using the rotary cutting blade. In other further embodiments, it is to be understood that the rotary cutting blade is used without first making the bored or drilled hole into the workpiece 86 (i.e., by making the initial tangential cut into the side of the workpiece 86 using the rotary cutting blade).

In another further embodiment of the method, the step of rotating the workpiece comprises manually rotating the workpiece 86 using a hand crank. In an alternative further embodiment, the step of rotating the workpiece 86 comprises automatically rotating the workpiece 86 using an actuator, such as an electric motor.

In one or more further embodiments of the present invention, the workpiece support assembly 30 comprises workpiece rotational means that is operated by a computer numerical control (CNC) system. Similarly, in one or more further embodiments, the cutting assembly 12 comprises a cutting device that is operated by a computer numerical control (CNC) system.

In one or more alternative embodiments of the present invention, the workpiece support assembly 30 is in the form of a tabletop device, wherein the tabletop device is configured to support a workpiece 86 thereon. Also, in one or more alternative embodiments, the cutting apparatus is configured to be attached to one of: (i) an excavator, (ii) a skid-steer loader, (iii) a backhoe, and (iv) a fork lift.

It is readily apparent that the aforedescribed cutting apparatuses 10, 10', 10", 10'", 10"", 200, 200', 200", 200'", and 200“ ” offer numerous advantages. First, the cutting apparatuses 10, 10', 10", 10'", 10", 200, 200', 200", 200'", and 200" are capable of more efficiently producing cylindrical, conical, and/or annular stock materials. Moreover, the cutting apparatuses 10, 10', 10", 10'", 10", 200, 200', 200", 200'", and 200" are capable of substantially reducing the amount of waste materials that are generated when forming cylindrical, conical, and/or annular stock materials. Furthermore, the cutting apparatuses 10, 10', 10", 10'", 10"", 200, 200', 200", 200'", and 200" can be used to practice one or more methods for forming cylindrical, conical, and/or annular stock materials, which can result in a significant reduction of the amount of raw materials that are consumed during production of a particular quantity of stock materials, as compared to conventional cutting methods.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A cutting apparatus, comprising:

a workpiece support assembly, said workpiece support assembly configured to hold a workpiece in position by means of at least one rotational attachment point, said workpiece support assembly allowing generally a single degree of freedom rotation while said workpiece is being cut, and said workpiece support assembly generally fixing said workpiece in the other directions of movement during the cutting thereof, wherein said workpiece support assembly further comprises a base frame for supporting said at least one rotational attachment point; and a cutting assembly having a linearly displaceable cutting blade, said linearly displaceable cutting blade configured to tangentially engage said workpiece, and circumferentially cut a portion of material from said workpiece;

a swing arm assembly coupled to said base frame of said workpiece support assembly, said swing arm assembly configured to support said portion of material circumferentially cut from said workpiece after said cut portion of material has been removed from said workpiece, said cut portion of material configured to be slid onto a portion of said swing arm assembly after the cut has been completed;

wherein said workpiece support assembly further comprises a tailstock assembly, and wherein said at least one rotational attachment point includes a rotational attachment point disposed on said tailstock assembly;

wherein a lower section of said tailstock assembly is rotatably coupled to said base frame of said workpiece support assembly; and wherein said swing arm assembly is configured to detachably engage with said tailstock assembly so as to facilitate the sliding of said cut portion of material from said workpiece to said swing arm assembly.

2. The cutting apparatus according to claim 1, wherein said workpiece rotates about a rotational axis while being cut, said rotational axis of said workpiece being disposed generally parallel to a longitudinal extending direction of said linearly displaceable cutting blade, said rotational axis of said workpiece being disposed in a generally horizontal direction or a generally vertical direction.

3. The cutting apparatus according to claim 1, wherein said workpiece rotates about a rotational axis while being cut, said rotational axis of said workpiece being disposed at an acute angle relative to a longitudinal extending direction of said linearly displaceable cutting blade.

4. The cutting apparatus according to claim 1, wherein said workpiece support assembly further comprises a headstock assembly, and wherein said at least one rotational attachment point further includes an additional rotational attachment point disposed on said headstock assembly.

5. The cutting apparatus according to claim 1, wherein said swing arm assembly is rotatably disposed relative to said workpiece support assembly.

6. The cutting apparatus according to claim 1, wherein said swing arm assembly comprises inner and outer upper arm members, said inner upper arm member being telescopically received within said outer upper arm member so as to allow said inner upper arm member to be slidably adjusted relative to said outer upper arm member.

7. The cutting apparatus according to claim 6, wherein said swing arm assembly further comprises a base member, and wherein a height of said inner and outer upper arm members relative to said base member is selectively adjustable by a user of said cutting apparatus.

8. The cutting apparatus according to claim 1, wherein said base frame further comprises a lower base frame section and an upper base frame section, said upper base frame section being pivotally coupled to said lower base frame section so as to enable said linearly displaceable cutting blade to cut said workpiece at an angle relative to a rotational axis of said workpiece.

9. The cutting apparatus according to claim 8, wherein said upper base frame section is pivotally coupled to said lower base frame section by means of one or more hinge members, each of said one or more hinge members being in the form of barrel hinges with removable pin members.

10. The cutting apparatus according to claim 8, wherein said workpiece support assembly additionally comprises a scissor jack subassembly, said scissor jack subassembly configured to elevate a side of said upper base frame section above a side of said lower base frame section, thereby forming a gap between said side of said upper base frame section and said side of said lower base frame section.

11. The cutting apparatus according to claim 1, wherein said cutting assembly comprises one of a band saw and a chain saw, said linearly displaceable cutting blade forming a part of one of said band saw and said chain saw.

12. The cutting apparatus according to claim 1, wherein said cutting assembly further comprises a support frame with opposed base frame members that are respectively attached to opposed upright support post members, each of said opposed base frame members comprising one or more wheel assemblies or each of said opposed base frame members engaging respective rail members for enabling said cutting assembly to be displaced relative to said workpiece support assembly.

13. The cutting apparatus according to claim 12, wherein said cutting assembly further comprises a cutting device, said linearly displaceable cutting blade forming a part of said cutting device, said cutting device being adjustably supported on said opposed upright support post members.

14. The cutting apparatus according to claim 1, wherein said workpiece support assembly comprises a workpiece rotational means that is operated by a computer numerical control (CNC) system, wherein said workpiece rotational means includes said at least one rotational attachment point; and/or wherein said cutting assembly comprises a cutting device that is operated by said computer numerical control (CNC) system, wherein said linearly displaceable cutting blade forms a part of said cutting device.

15. A cutting apparatus, comprising:

a workpiece support assembly, said workpiece support assembly configured to hold a workpiece in position by means of at least one rotational attachment point, said workpiece support assembly allowing generally a single degree of freedom rotation while said workpiece is being cut, and said workpiece support assembly generally fixing said workpiece in the other directions of movement during the cutting thereof, said workpiece support assembly including at least one vertically extending support member connected to a base frame, and said at least one rotational attachment point including a rotational attachment point coupled to said at least one vertically extending support member; and a cutting assembly having a linearly displaceable cutting blade, said linearly displaceable cutting blade being disposed in a generally horizontal direction, said cutting assembly being spaced apart from said at least one vertically extending support member of said workpiece support assembly, said linearly displaceable cutting blade configured to initially form a straight tangential cut into said workpiece, and thereafter circumferentially cut a portion of material from said workpiece, said cutting assembly configured to be displaced relative to said workpiece support assembly during the forming of said straight tangential cut; and a swing arm assembly coupled to said base frame of said workpiece support assembly, said swing arm assembly configured to support said portion of material circumferentially cut from said workpiece after said cut portion of material has been removed from said workpiece, said cut portion of material configured to be slid onto a portion of said swing arm assembly after the cut has been completed;

wherein said at least one vertically extending support member comprises a tailstock assembly, and wherein said at least one rotational attachment point includes a rotational attachment point disposed on said tailstock assembly;

wherein a lower section of said tailstock assembly is rotatably coupled to said base frame of said workpiece support assembly; and wherein said swing arm assembly is configured to detachably engage with said tailstock assembly so as to facilitate the sliding of said cut portion of material from said workpiece to said swing arm assembly.

* * * * *